343-872 SR
10/6/81 XR 4,293,861

United States Patent [19]

Winegard et al.

[11] 4,293,861

[45] Oct. 6, 1981

[54] COMPACT TELEVISION ANTENNA SYSTEM

[75] Inventors: John R. Winegard, Evergreen; Carey W. Shelledy, Lakewood; Keith B. Cowan, Arvada, all of Colo.

[73] Assignee: Winegard Company, Burlington, Iowa

[21] Appl. No.: 110,493

[22] Filed: Jan. 8, 1980

[51] Int. Cl.[3] ..... H01Q 3/00; H01Q 21/00

[52] U.S. Cl. ..... 343/766; 343/809; 343/816; 343/872; 343/883

[58] Field of Search ..... 343/812-816, 343/872, 880, 766, 809, 883

[56] References Cited

U.S. PATENT DOCUMENTS

| | | | |
|---|---|---|---|
| 2,558,727 | 7/1971 | Bernet | 343/813 |
| 2,992,430 | 7/1961 | Winegard | 343/814 |
| 3,007,167 | 10/1961 | Winegard | 343/803 |
| 3,321,764 | 5/1967 | Winegard | 343/815 |
| 3,329,960 | 7/1967 | Winegard | 343/819 |
| 3,475,759 | 10/1969 | Winegard | 343/815 |
| 3,503,074 | 3/1970 | Carter | 343/792.5 |
| 3,531,805 | 9/1970 | Winegard et al. | 343/727 |
| 3,710,337 | 1/1973 | Grant | 343/815 |
| 4,038,662 | 7/1977 | Turner | 343/813 |

OTHER PUBLICATIONS

RCA, AC-DC Mini-State Antenna System Operating Instructions, 3F4511.

*Primary Examiner*—Eli Lieberman
*Attorney, Agent, or Firm*—Robert C. Dorr

[57] ABSTRACT

A highly compact and lightweight 82 channel all banded VHF-UHF television antenna having three antenna elements wherein each element is the identical physical length and each element includes two half sections. Each antenna element is separated a predetermined distance from each other element wherein the predetermined distance is substantially less than one-tenth of the shortest wave length in the VHF band. A first set of coils are utilized to electrically lengthen the halves of the two elements for reception in the VHF band and a second set of coils are utilized to provide proper delays between the signals received by each antenna element so that when the signals are combined the signals are substantially additive and in phase. The antenna system includes a weatherproof housing containing a rotor, a preamplifier, and electronic circuitry. A deloading mechanism is arranged around the housing to engage the circumference of each antenna element to provide stability under the driving forces that may occur in the atmosphere.

30 Claims, 28 Drawing Figures

Fig. 6
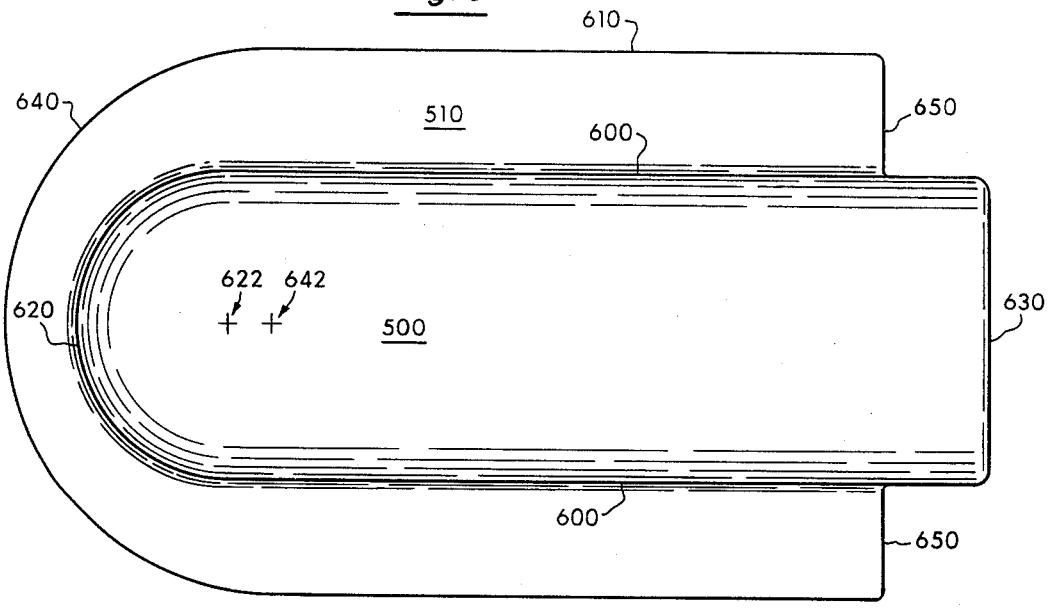
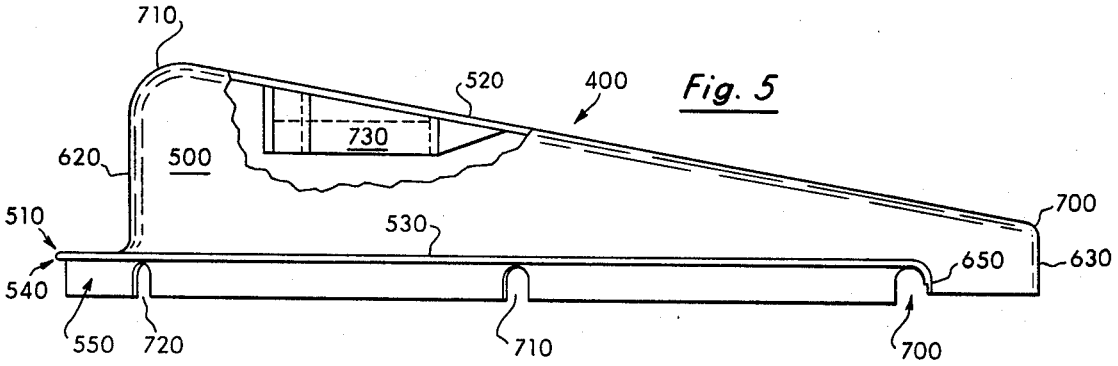
Fig. 5
Fig. 8
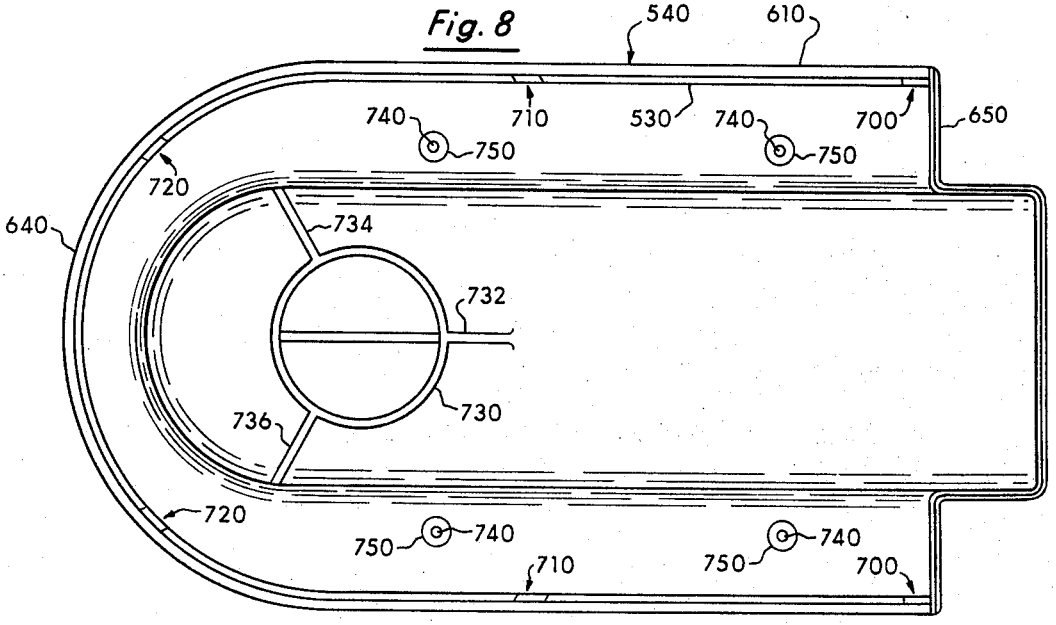

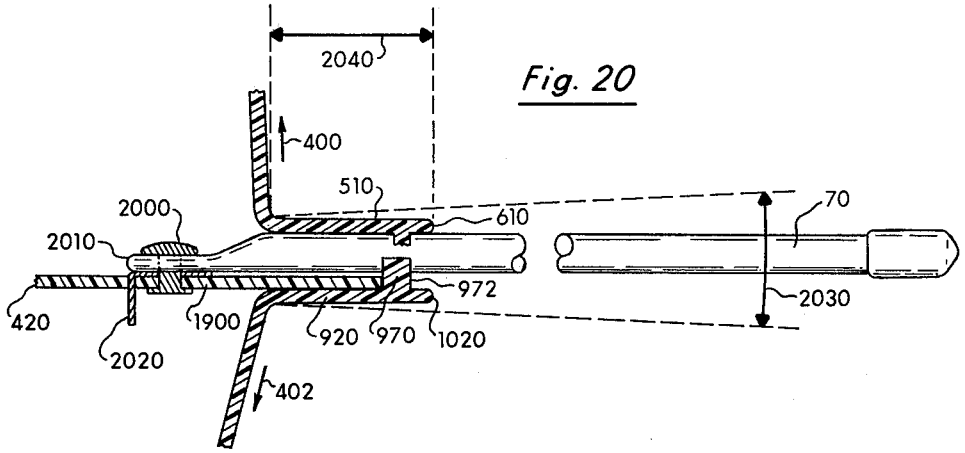
Fig. 20
Fig. 13
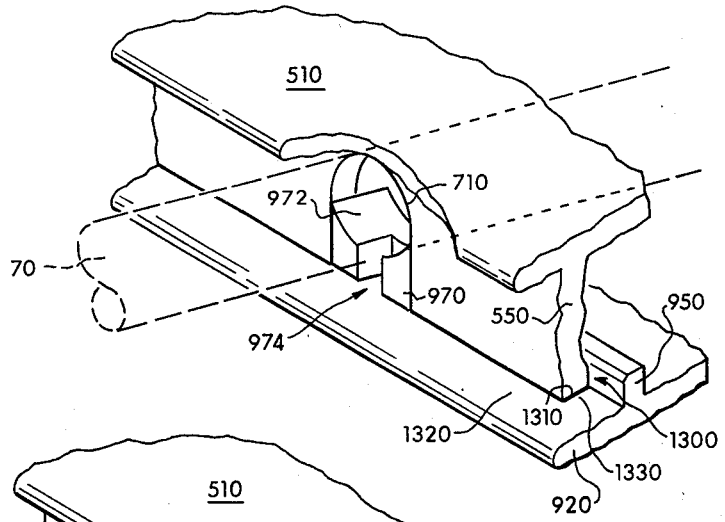
Fig. 14
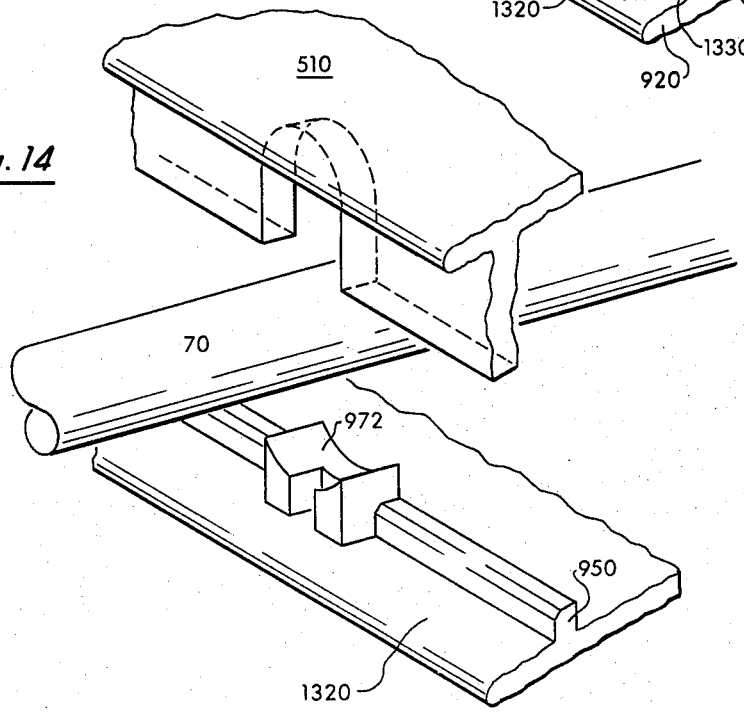

COMPACT TELEVISION ANTENNA SYSTEM

BACKGROUND OF THE INVENTION

1. Field of Invention

This invention relates to a highly compact all-channel television antenna. More particularly, it relates to an all-channel television antenna having the antenna elements the same physical length.

2. Discussion of the Prior Art

Over the past several decades, the art of television antenna design has become quite sophisticated. Two general consumer categories of antennas have evolved. The first category contains the "multi-element" UHF-VHF large antennas which typically comprise numerous elements in each antenna in order to improve the gain and directivity of the television signal across the 82 channel VHF-UHF bands. Examples of such prior art approaches are:

| U.S. Pat. No. | Inventor | Date |
|---|---|---|
| 3,531,805 | Winegard et al | Sept. 29, 1970 |
| 3,475,759 | Winegard | Oct. 28, 1969 |
| 3,329,960 | Winegard | July 4, 1967 |
| 3,007,167 | Winegard | Oct. 31, 1961 |
| 2,992,430 | Winegard | July 11, 1961 |
| 3,321,764 | Winegard et al | May 23, 1967 |

One such prior art approach is conventionally available from the WINEGARD COMPANY known as the CHROMSTAR VHF-UHF line of antennas. The largest of this series is the Model CH-8200 (U.S. Pat. No. 2,992,430) comprising a total of 43 elements (29 UHF elements and 22 VHF elements) having a boom length of 173 inches, a turning radius of 98 inches, and a maximum width of 108 inches. The smallest UHF-VHF antenna in the CHROMSTAR series is the model CH-7074 having a total of seven elements (4 VHF and 3 UHF) with a boom length of 34½ inches, a turning radius of 56 inches, and a maximum width of 108 inches.

In the conventionally available GOLD STAR line from the WINEGARD COMPANY, the VHF portion of the antennas are substantially "V" types and the smallest UHF-VHF antenna in this series has a total of ten elements (3 VHF and 7 UHF) with a boom length of 26¾ inches, a turning radius of 48½ inches, and a maximum width of 89 inches.

Another series of conventionally available "multi-element" large antennas available from the WINEGARD COMPANY are called PREMIER "X" and these antennas intermix both VHF and UHF signals on the same linear plane. The smallest UHF-VHF antenna in this series has five elements (Model X-15).

The second general category of consumer VHF-UHF television antennas may properly be termed "rabbit-ears." The WINEGARD COMPANY also manufactures a conventional series of VHF-UHF indoor antennas known as the COLOR CEPTOR line and the POWERBEAM line. All of these prior art approaches are designed to have a base member which preferably sets on the top of a television set with at least two upstanding adjustable antenna elements affixed thereto. In addition, a UHF upstanding circular element may also be provided. Rabbit ear antennas, however, are not known for significant response.

A consumer antenna nearing (or approaching) the performance of the large multi-element antennas, yet combining the size and lightweight of the small rabbit-ears antennas would form a third classification of consumer VHF-UHF television antennas. The SENSAR line conventionally available from WINEGARD COMPANY (Models SR-20A, SR-30M, and RVH-2K) properly falls in this category.

The Radio Corporation of America (RCA) also manufactures an antenna in this third consumer category which is identified as Model 5MS550 and termed the AC-DC MINI-STATE ANTENNA SYSTEM. The RCA system contains a miniaturized uni-directional antenna, a solid state amplifier and an electrical rotating mechanism all housed inside a weather-proof housing. The diameter of the housing of the RCA system is 20½ inches. The VHF section of the RCA system is a circular shaped, slot tune, broad band, uni-directional traveling wave antenna. The UHF section, on the other hand, is a broad band multi-element array. The VHF signal must be amplified and then is combined with an unamplified UHF signal by means of an adder circuit.

The present invention more properly falls in the third category of consumer antennas. The antenna system of the present invention performs like a large multi-element antenna twice its size yet maintains the compactness and lightweightness of the rabbit-ear consumer category. Like the RCA antenna system, the antenna system of the present invention utilizes a unique weather-tight housing and can optionally contain a rotor for rotating the antenna, and a preamplifier circuit. Unlike the RCA system, the preamplifier is not necessary for operation of the antenna. The rotor is protected against dirt and weather for long life and enables the antenna to rotate substantially 360°. More importantly, and in contrast to the RCA system, the antenna system of the present invention utilizes outwardly extending antenna elements for the entire VHF-UHF band. Unlike the large television antennas of the first category, the antenna system of the present invention utilizes no horizontal crossarms or booms, as conventionally termed, and hence does not require conventional saddle supports of insulating materials or the like. However, since the antenna of the present invention does utilize outwardly extending antenna elements, these elements are positively locked to substantially minimize sagging, and/or misaligning due to windloading, icing, and the like.

Most fundamentally, the antenna system of the present invention contains six outwardly extending antenna halves forming three elements, each having the same physical length. No prior art all band VHF-UHF television antenna utilizes such an element configuration. From a manufacturing and cost viewpoint, the antenna system of the present invention represents a major breakthrough. Only one size of element need be manufactured and stocked.

The six element halves are combined into three elements wherein the first and second elements are utilized primarily to receive a VHF signal in the low band and wherein the second and third elements are utilized primarily to receive signals in the high VHF band. The physical spacing between each element is substantially the same and is substantially less than one-tenth of a wave length of the shortest VHF wave length.

The VHF frequency range includes a low VHF band of 54 mHz to 88 mHz (channels 2–6) and a high VHF band of 174 mHz to 216 mHz (channels 7–13). Hence the shortest wavelength in the VHF range occurs at 216 mHz with 54.3"—the one-tenth wavelength being 5.43". Conventionally the spacings between the VHF antenna elements may be a quarter wavelength (i.e., 13.6") and the element halves are interconnected in a crossover fashion (front fed) so that the combined signals are in phase to be additive. As set forth in U.S. Pat. No. 3,392,399 (issued to WINEGARD on July 9, 1968) the spacings between the driven VHF dipoles can be reduced to minimum spacing of approximately one-tenth of a wavelength with reference to the high end of the high VHF band. Hence, spacings of 5.75 inches were achieved by using a transmission line having a series of serpentine or sinusoidal convolutions formed in a plane parallel to the plane of the dipole elements. The antenna of the present invention achieves a spacing between the driven elements substantially less than one-tenth of a wavelength with respect to the same reference. Again, the high degree of compactness of the antenna system of the present invention is due in part to the close physical spacing between the elements as taught in the present invention. This contributes significantly to the overall compactness of the antenna and the lightweightness of the antenna. Significant breakthroughs in manufacturing costs are also obtained.

As a result, the all band UHF-VHF antenna system of the present invention, in a preferable embodiment, has a turning radius of just under 30 inches, a housing longitudinal length of approximately 8 inches, utilization of six identical silver anodized antenna element halves (three elements), a physical weight in the shipping carton of less than two pounds, and a weatherproof housing which may optionally contain a rotor and preamplifier.

SUMMARY OF THE INVENTION

The antenna system of the present invention includes a support mast, a weatherproof housing, a rotor arrangement, a preamplifier circuit, and three identically sized silver anodized outwardly extending elements.

The support mast may include the conventional cylindrically shaped support mast which can be mounted vertically to the roof or inside the attic of a building or it may include in another embodiment a pole similar to the pole supporting pole lamps which can be mounted on the interior of the building between the floor and ceiling of the room. The housing can selectively receive different sizes of diameters of support masts within a preferable range.

The housing of the present invention includes an upper and lower portion which engage in a weather tight relationship having drain holes formed in the bottom portion thereof to permit any condensation from humidity from building up. Furthermore, an outwardly extending lip is formed around the housing which engages the circumference of the outwardly extending elements at a predetermined distance from where the elements are affixed in the interior of the housing to provide deloading of any moment force caused by the atmospheric elements on the outwardly extending antenna elements. The deloading occurs when the lip flexes through a predetermined apex angle. The engagement of the housing with each element firmly locks the element in a given configuration.

A rotor mechanism is positioned on the interior of the housing which includes a motor and a gear mast. The gear mast is capable of freely rotating on the interior of the housing between the upper and lower portions and is releasably connected to the support mast. A rotor motor operatively engages the gear mast to cause the entire housing to turn about the support mast. A control device senses the stop position of the gear mast with respect to the housing to prevent multiple 360° rotation in the same direction.

Disposed on the interior of the housing is a support board to which the six antenna halves having identical lengths extend therefrom. The upper and lower portions of the housing provide positive locking for each half. A first element located at the rear of the housing forms a dipole in a horizontal plane. A second element is spaced a predetermined distance from the first element and is oriented to lay in the same horizontal plane but is further oriented in a V-type configuration with the apex angle forming substantially 135° and directed towards the front of the housing. The third element is also oriented a predetermined distance from the second element to form an apex angle of substantially 60° and directed towards the front.

A pair of electrical lengthening coils are connected to the first element halves and a second pair of electrical lengthening coils are connected to the second element halves. These two elements in cooperation with their respective lengthening coils are capable of receiving composite low band VHF signals. The second element in cooperation with the second pair of lengthening coils and the third element are capable of receiving composite high band VHF signals. The configuration of the third element, by itself, is capable of receiving UHF signals. The first element also acts as a reflector for high band VHF signals and the second element acts as a reflector for signals in the UHF band.

OBJECTS OF THE INVENTION

It is an object of the present invention to provide a new and novel VHF-UHF antenna having a high degree of compactness with good reception performance.

It is another object of the present invention to provide a new and novel VHF-UHF antenna wherein all antenna elements are the same physical length.

It is another object of the present invention to provide a new and novel deloading device engaging an outwardly extending antenna element.

It is another object of the present invention to provide a new and novel waterproof housing for an antenna system.

It is another object of the present invention to provide a new and novel apparatus for enabling VHF antenna elements to be spaced less than one-tenth of the wavelength of the highest VHF frequency the antenna elements are designed to receive.

DESCRIPTION OF THE DRAWINGS

FIG. 5 is a side planar view with partial cut away of the upper portion of the housing of the present invention.

FIG. 6 is a top planar view of the upper portion of the housing of the present invention.

FIG. 8 is a bottom planar view of the upper portion of the housing of the present invention.

FIG. 13 is an enlarged prospective view showing the engagement of an antenna element half with the sides of the upper and lower housing portions of the present invention.

FIG. 14 is an exploded representation of the view set forth in FIG. 13.

FIG. 20 is a cross sectional view of one antenna element half as it engages the housing and support board of the present invention showing the deloading characteristic.

GENERAL DESCRIPTION

Figure 1:
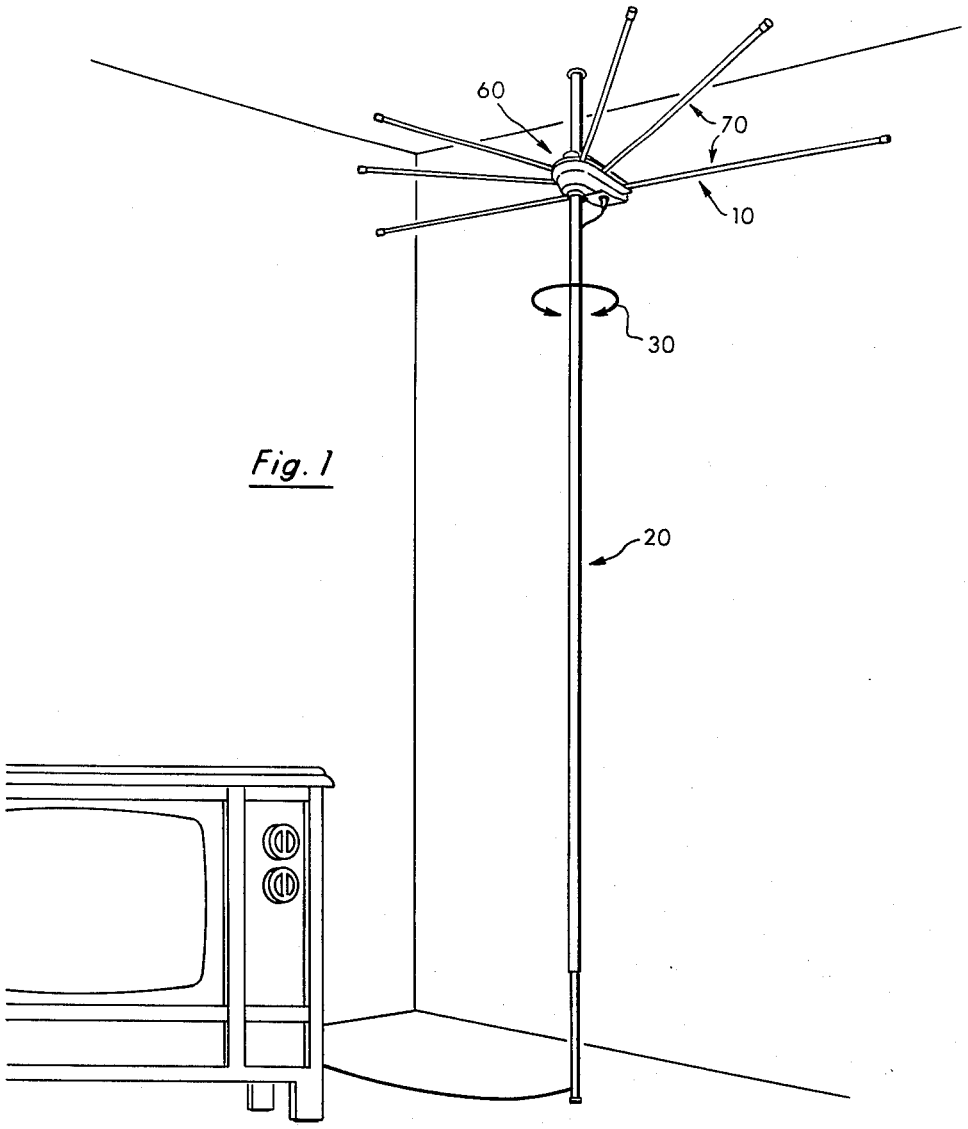
FIG. 1 is an illustration of the antenna system of the present invention operatively engaging the ceiling and floor of a room.

The compact antenna system 10 of the present invention is shown in FIG. 1 installed in a room of a building, such as, for example, an apartment in an apartment complex. In this environment, the antenna 10 of the present invention is mounted to a support mast 20. The antenna 10 is cabable of rotation in the directions of arrow 30. In being rotated in the directions of arrow 30, the antenna will rotate a full 360° and then stop.

The mast 20 can be of the type conventionally used for pole lamps and firmly engages the floor and the ceiling of the room although modified according to the teachings of the present invention.

Figure 2:
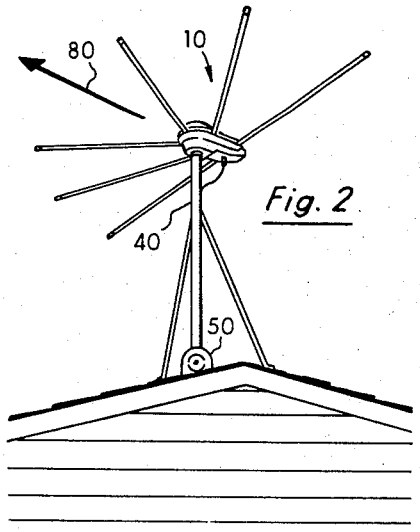
FIG. 2 is an illustration of the antenna system of the present invention being mounted to the roof of a building.
Figure 3:
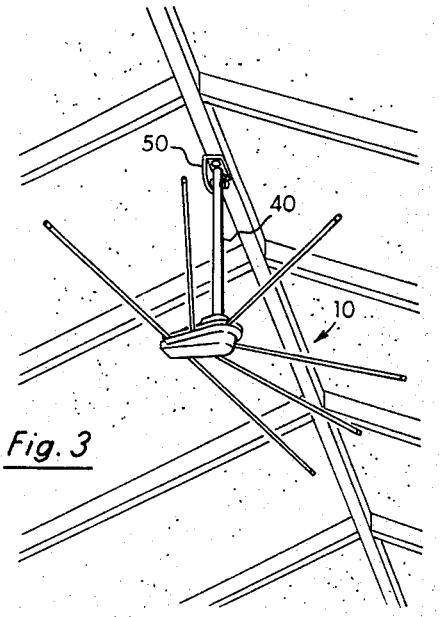
FIG. 3 is an illustration of the antenna system of the present invention being mounted in an inverted fashion to the inside of an attic of the building.

The compact antenna system 10 of the present invention is capable of being mounted in a variety of other places such as on the roof of a building, as shown in FIG. 2, or in the attic or garage of a building as shown in FIG. 3. In FIGS. 2 and 3, the antenna is supported by a support mast 40. Mast 40 engages a universal bracket 50 which can be affixed by conventional means to a solid support such as the main beam of a roof.

As shown in FIG. 1, the compact antenna system 10 of the present invention has a water proof housing 60 which is mounted to the mast 20 and six silver annodized elements 70 which are of equal length.

As shown in FIG. 2, the compact antenna 10 of the present invention is designed to be rotated so that the mid-longitudinal position, as indicated by arrow 80, for optimum performance of the antenna, should be directed towards the station to be received.

Hence, it can be observed in FIGS. 1 through 3, that the compact antenna 10 of the present invention is designed to be utilized inside the room of a building, the attic of a building, or on the roof of a building.

Figure 4:
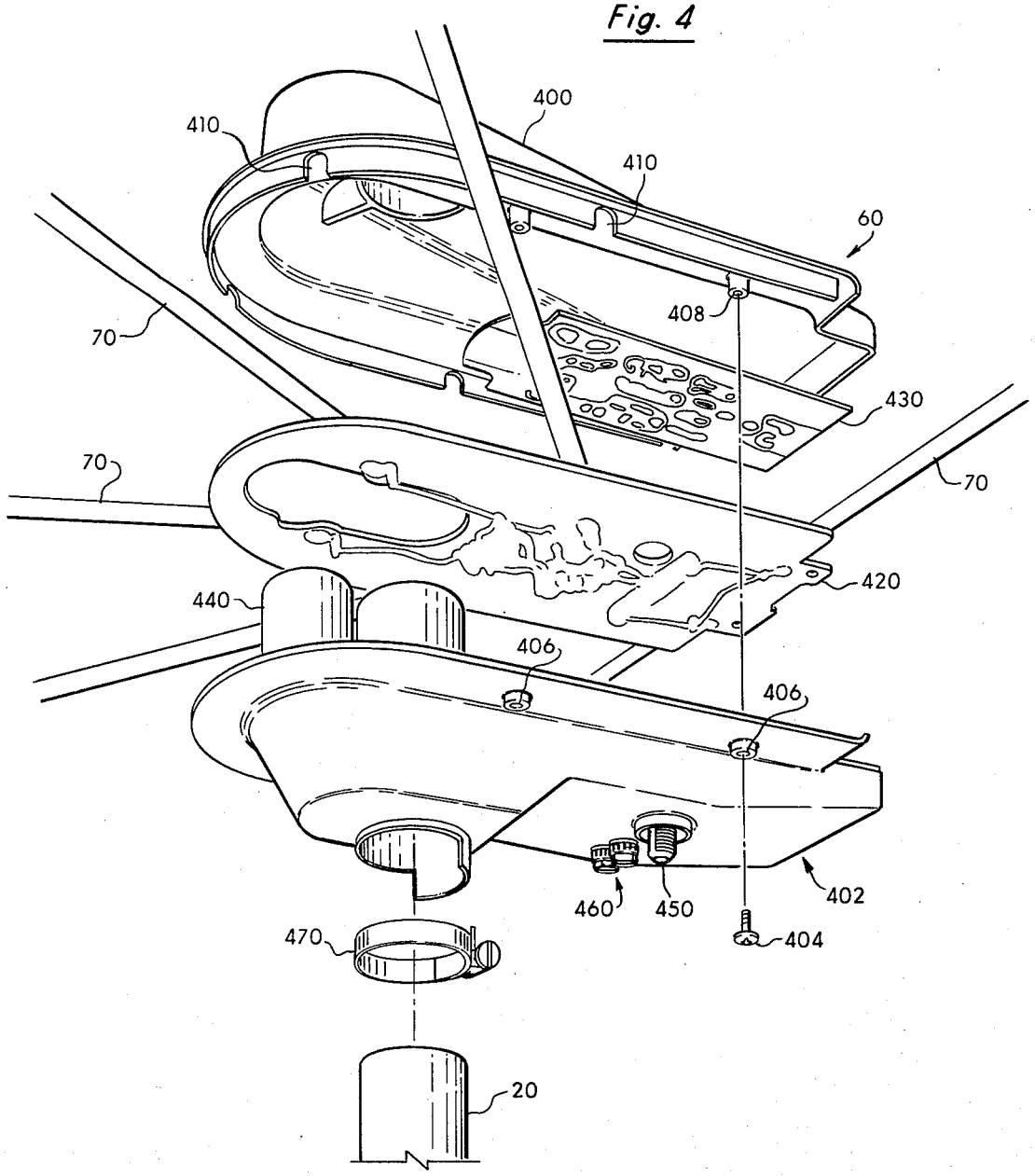
FIG. 4 sets forth an exploded perspective view of the various components of the present invention.

FIG. 4 sets forth the various components of the compact antenna system 10 of the present invention. The housing 60 contains an upper half 400 and a lower half 402. The two halves are made from high impact ABS all-weather plastic and are held together to form housing 60 by means of four screws 404 which engage holes 406 on the lower half 402 with the holes 408 on the upper half 400. As previously mentioned, the elements 70 are of equal length and are made from silver annodized, corrosion protected aluminum material. These elements are fixedly positioned by the housing 60 by means of a plurality of slots 410. Hence, when the housing is assembled by screws 404, the housing fixedly positions the elements at predetermined angles with each other.

Circuit board 420 contains a grouping of electrical components which enables the antenna 10 of the present invention to electrically lengthen the elements 70 and to delay signals according to the teachings of the present invention.

Positioned above and mounted to this circuit board 420 is a VHF-UHF solid state signal amplifier 430. This solid state signal amplifier is optional with the antenna and serves to increase the amount of signal received by the elements 70 and by the circuit board 420. One of the features of the present invention relates to the fact that should this amplifier 430 malfunction, it can selectively be removed from housing 60 and the antenna 10 of the present invention will still function to receive signals for the consumer. This minimizes any inconvenience to the user.

A longer-life optional rotor 440 is also contained within housing 60. The use of the rotor allows the directivity of the antenna to be utilized and is especially valuable in geographical areas where the television stations are in different directions. The use of the rotor 440 also helps to reduce ghosting.

A series of connectors ae provided to the housing 60. Connector 450 is a conventional connector for coaxial cable which interconnects with the television set. In a preferred embodiment, a predetermined length of 75-OHM coaxial cable engages connector 450. Connectors 460 are for inter-connecting with the wires which control the rotor 440. These wires are conventional 300-OHM twin lead wire also of predetermined length.

Finally, a stainless steel clamp 470 holds the antenna housing 60 rigidly to the mast 20.

DETAILED DESCRIPTION

Housing

FIG. 5 sets forth the upper half 400 of housing 60 to include an upper slanted portion 500 and a lower lip portion 510. Both portions are integral with each other and are made from high impact ABS plastic from a single mold.

As shown in FIG. 6, longitudinal sides 600 of the upper slanted portion correspond to the longitudinal sides 610 of the lower lip portion 510 in a parallel fashion. The longitudinal edge 600 terminates at one end in a circular edge 620 and terminates at the opposing end in a flat edge 630.

The edge 610 of the lower lip portion 510 also terminates in a circular edge 640. The center of the radius of the edge 640, however, is located at point 642 whereas the center of the circular edge 620 is located at 622. At the opposing end, longitudinal edge 610 ends in a flat edge 650 which drops to a point substantially near the longitudinal edge 600. This configuration is specifically set forth in FIG. 6.

Figure 7:
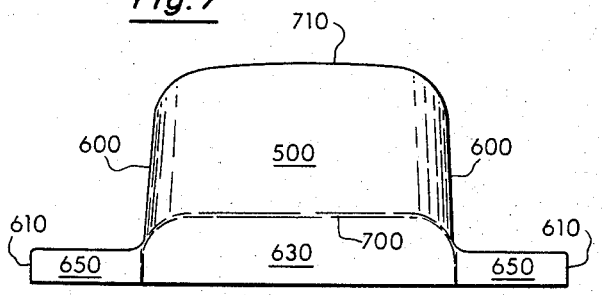
FIG. 7 is an end planar view of the upper portion of the housing of the present invention.
Figure 11:
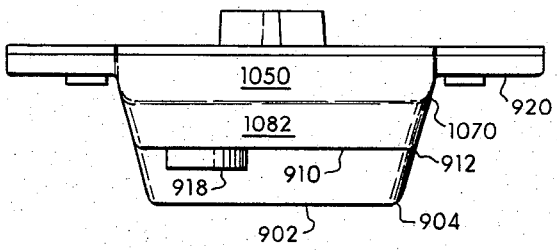
FIG. 11 is an end planar view of the lower portion of the housing of the present invention.

As shown in FIG. 7, the upper slanted portion 500 elevates from the upper portion 700 of edge 630 and linearly reaches a maximum height at edge 710. This is clearly shown by reference to FIG. 5 along line 520. On the contrary, the lower lip portion 510 is flat from edge 650 to circular edge 640 along line 530 as best shown in FIG. 5. As shown in FIG. 7, the edges 600 of the upper slanted portion 500 tapers slightly inwardly and the engagement with the surface 520 is also rounded.

The lower lip portion 510 includes an outwardly extending lip 540 as best shown in FIG. 5 and a downwardly extending rim 550. As shown in FIG. 8, the rim 530 is slightly set in from the outer edge 610 of lip 540 as best shown in FIG. 8. The rim 530 extends from edge 650 along the edges 610 and is concentric to circular edge 640. Formed in the rim 530 at predetermined locations are a plurality of U-shaped openings designated 700, 710 and 720. These U-shaped openings are oriented to provide a particular angular position to the elements 70 as will be more fully described subsequently.

The interior of the upper housing 400 conforms to the exterior configuration previously discussed separated by a thin wall construction. However, centrally disposed on the interior of the upper slanted portion 500 is a cylindrical protrusion 730 as best shown in FIGS. 5 and 8. This cylindrical region 730 serves as an annular receptacle for supporting one end of the mast 20. Disposed around the cylinder 730 are a series of supports 732, 734 and 736 which provide rigidity to the cylinder 730. In other words, under severe stress such as in a windstorm, the receptacle 730 will not dislodge and separate from the upper housing. When the housing is used in the environment of a room, as shown in FIG. 1, the surface 500 has a hole punched through corresponding in shape to the outer circumference of the support mast which allows it to pass through. The rib in the center of receptacle 730 is provided for the top end of a gear, discussed later, mast to abut. As will be discussed later the housing is capable of receiving masts having different diameters.

Finally, a series of holes 740 are formed in a series of upstanding posts 750.

Figure 9:
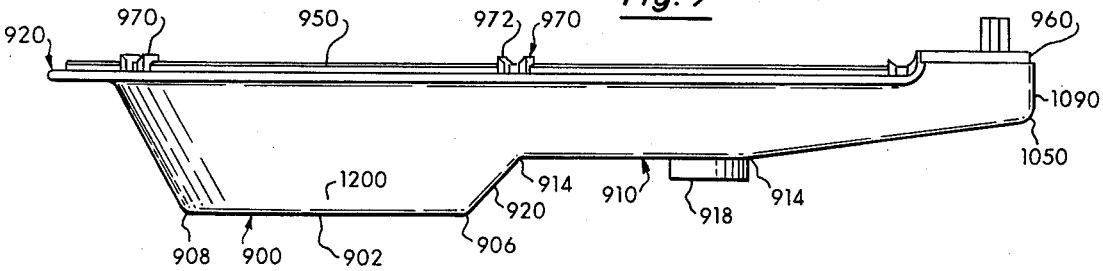
FIG. 9 is a side planar view of the lower portion of the housing of the present invention.
Figure 10:
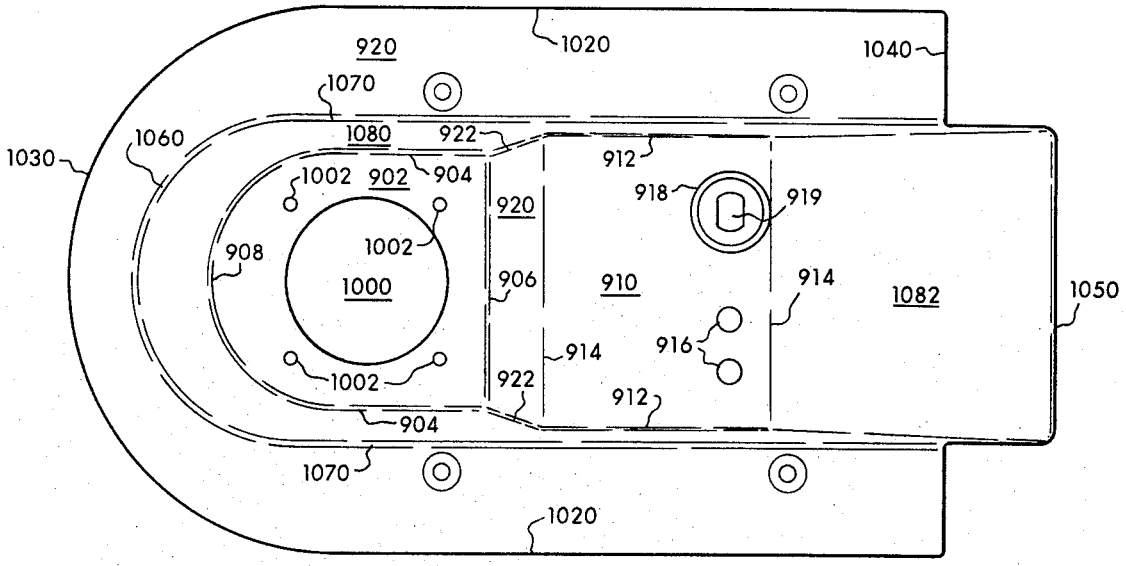
FIG. 10 is a bottom planar view of the lower portion of the housing of the present invention.

In FIGS. 9 through 12 are set forth the details of the lower half 402 of the housing 60. The lower half 402, as shown in FIG. 9, contains a lower plateau region 900, a mid-plateau region 910 and an upper lip portion 920. Lower plateau portion 900 contains a flat surface 902 which, as shown in FIG. 10, has a circular hole 1000 formed therethrough and a plurality of holes 1002 disposed around the hole 1000 and arranged at the corners of a square. These holes are drain holes and allow any condensation of water which should form in the interior of the housing to be drained out. Surface 902 is bounded by longitudinal sides 904 which are parallel to each other and which terminate at one end in a flat edge 906 and in a circular edge 908 at the opposite end thereof.

The mid-plateau region 910, as shown in FIG. 10, is a substantially rectangular region bounded on the longitudinal sides by parallel edges 912 and at opposing ends by parallel edges 914. Disposed on the mid-plateau surface 910 are two holes 916 through which pass connectors 460. A raised cylindrical lip 918 is provided centrally around a hole 919. Through which the coaxial connector 450 is mounted therethrough. A conventional rubber boot is applied over the lip when the coaxial cable is affixed to the connector.

A slanted surface 920 is provided between edge 914 of the mid-plateau surface 910 and edge 906 of the lower plateau region 902. As shown in FIG. 10, tapering occurs along edges 922.

The upper lip 920 is designed to correspond in configuration to the lower lip portion 510 of FIG. 6. Hence, edge 1020 corresponds to edge 610, edge 1030 corresponds to edge 640, edge 1040 corresponds to edge 650 and edge 1050 corresponds to edge 630 in configuration and dimension.

The lower plateau region 902 tapers from edge 908 into edge 1060 which is circular in shape corresponding substantially to the radius of curvature of edge 620. Edge 1060 engages parallel longitudinal sides 1070 which substantially correspond to edges 600 of FIG. 6. A tapered region 1080 exists between edge 1070 and edges 904, 922, and 912. Finally, the rear edge 914 of the mid-plateau surface 910 tapers upwardly towards edge 1050 which thereupon engages the vertical end 1090.

It is obvious from inspection of FIG. 9 that should any condensation occur within the lower housing half 402 that the condensation will drain downwardly towards the bottom surface 902 and out through the drainage holes 1002.

Figure 12:
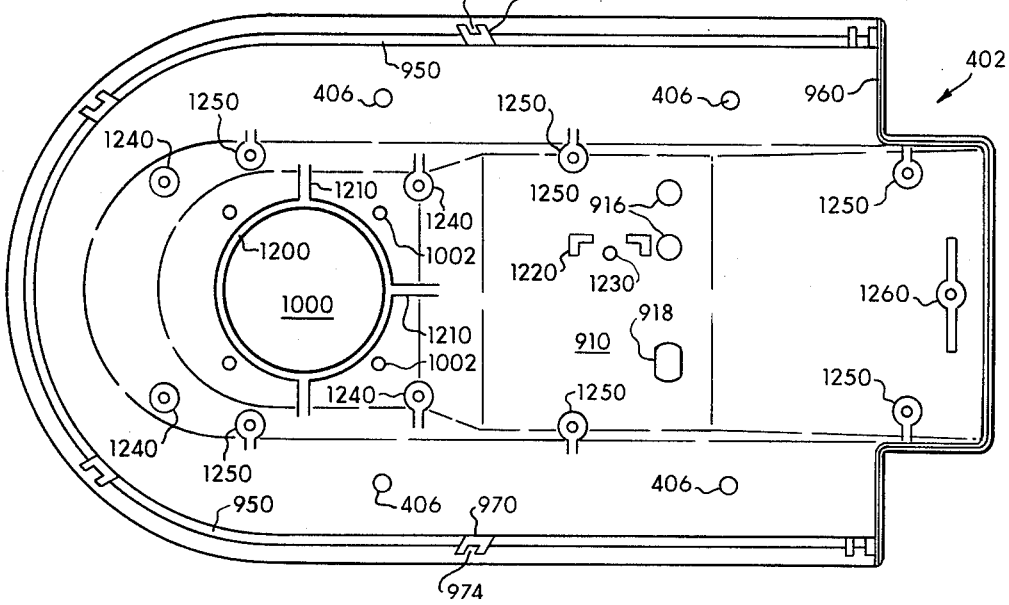
FIG. 12 is an upper planar view of the lower portion of the housing of the present invention.

As shown in FIG. 12, the formed hole 1000 through the lower plateau 902 has a raised lip 1200 on the interior of the lower housing 402. The raised lip 1200 has outstanding supports 1210 disposed therearound. On the interior of the housing 402 above the mid-plateau 910 are two supports 1220 for receiving a sensing switch, not shown. A formed pillar 1230 engages a hole of the sensing switch and when melted over the sensing switch firmly holds it in place against the supports 1220.

The only other times on the interior of the lower housing 402 are a large number of support posts. Support posts 1240 are designed to hold the bracket supporting the rotor assembly. Support posts 1250 are designed to hold the circuit board 420. Support post 1260 is designed to partially support the preamplifier board 430. Formed holes 406 are designed to aid in engaging the upper housing 400.

Formed on the lip 920 is an upstanding ridge 950, as best shown in FIGS. 9 and 12. The configuration of ridge 950 is such that it firmly engages the downwardly extending rim 550 of the upper housing half 400. Hence, when the upper half engages the lower half, as will be brought out in greater detail later, a seal is generated between the two housing halves. A similar ridge or rim 960 is formed on the rear half of the housing 402 and also engages the corresponding edges 630 and 650 of the upper housing half. Hence, around the periphery engaging the upper half 400 and the lower half 402, a water tight seal is formed.

Also formed on the lip 920 are a series of cupped support posts 970, as best shown in FIGS. 9 and 12. Each post 970 has a circular curved region or cup 972 which receives the bottom circular portion of an element 70. The longitudinal width of each post 970 is such that it is slightly less than the width between the U-shaped cavity 710 as shown in FIG. 5. Hence, and as will be subsequently discussed, the post tightly engages the sidewalls of the U-shaped cavity 710 to form a circular opening between the upper and lower housing which engages the antenna element 70. A recessed slot 974 is provided so that all walls are of uniform thickness for molding purposes.

The details of the interaction between the antenna element 70 and the upper and lower housing 400 and 402, respectively, are best shown by reference to FIGS. 13 and 14. When assembled, as shown in FIG. 13, the downwardly extending rim 550 from the upper housing 400 firmly abuts the upstanding ridge 950 of the lower housing half 402. The area of engagement is designated 1300 in FIG. 13. Furthermore, the lower surface 1310 of rim 500 firmly abuts and engages the top surface of lip 920 of the lower housing half. Hence the area of engagement designated 1330 in cooperation with the area of engagement designated 1300 provides a water tight seal between the upper and lower housing halves. This is especially true since surface 1300 is perpendicular to surface 1330 and this seal will sustain driven rain in an outside environment.

A water tight seal also exists completely around the circumference of the antenna element 70 and where it engages the U-shaped slot 710 and the cupped surface 972 of post 970. Since the lower housing half 402 is firmly affixed to the upper housing half 400, a water tight seal is maintained around the antenna element circumference 70. However, when water collects on the element and flows along the element to the housing 60, the water is collected and is disbursed outwardly of the housing.

As mentioned, a plurality of drain holes 1002 are provided in the bottom of the housing in order to drain condensation out. Although the housing 60 is water tight, it is not air tight and air carrying heavy humidity will normally condense and that condensation will drain out of the housing. It is to be noted, that due to the location of the drain holes 1002, it would be virtually impossible for any water driven in through the drain holes from the ambient environment outside of the housing 60 to be driven into the interior above the mid-plateau 910 or above region 1082 of the lower housing. Even if such moisture were driven that far inwardly, it would quickly and rapidly drain back out through the drain holes 1002.

Figure 15:
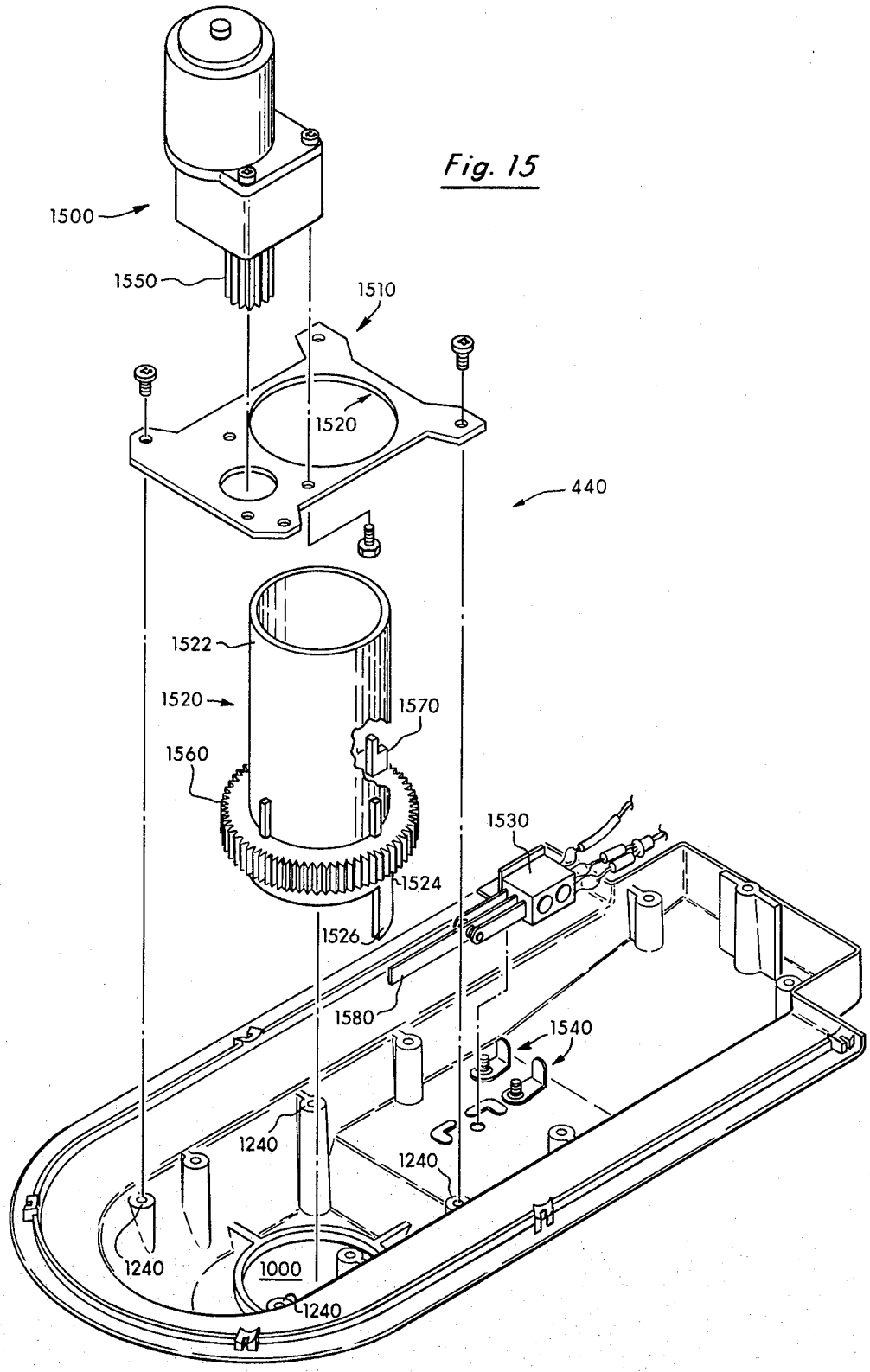
FIG. 15 is an exploded perspective view showing the details of the interior of the lower housing portion and the rotor motor mechanisms.

In FIG. 15 is shown the rotor assembly 440 of the present invention to include a rotor motor 1500, a support plate 1510, a gear mast 1520, and a control switch 1530. The combination set forth in FIG. 15 interconnects so that when appropriate control signals are delivered over terminals 1540, the switch 1530 depending on which state it is initially in commences to activate the rotor motor 1500 which through drive gear 1550 activates the large gear 1560 on the gear mast 1520 to rotate the antenna clockwise or counter clockwise. In order to prevent continuous rotation, a stop 1570 is provided on the gear mast 1520 to activate the sensor 1580 of switch 1530 to cause the motor rotor to stop. Rotation, at this point, is only possible in the opposite direction. The sensor switch switches 12 volts and is conventionally available from Guardian Electric or Switchcraft.

The rotor motor is commercially available from ROWE as the 500 series. The mounting plate 1510 is shown substantially configured so that a formed hole 1512 is slightly larger than the outer circumference of the upper portion 1522 of the gear mast 1520. In all other aspects, the mounting plate 1510 has suitable formed holes so that the motor can be firmly affixed to the mounting plate and then the mounting plate slidedly engages over the upper cylindrical portion 1520 of the gear mast and can be affixed by means of screws or the like to posts 1240.

The gear mast 1520 is of integral construction and is made from nylon type material. As can be seen by reference to FIG. 15, the lower portion of 1524 of the gear mast 1520 contains an outstanding protrusion 1526 to which the mast 20 can be affixed by means of a C clamp 470 as shown in reference to FIG. 4.

Figure 18:
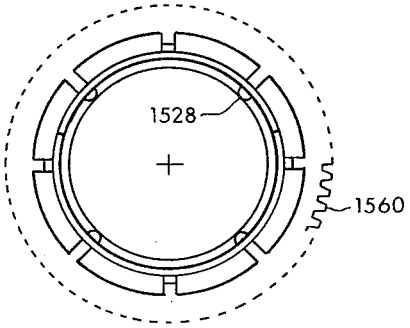
FIG. 18 is the opposing end view of the gear mast of FIG. 16.
Figure 16:
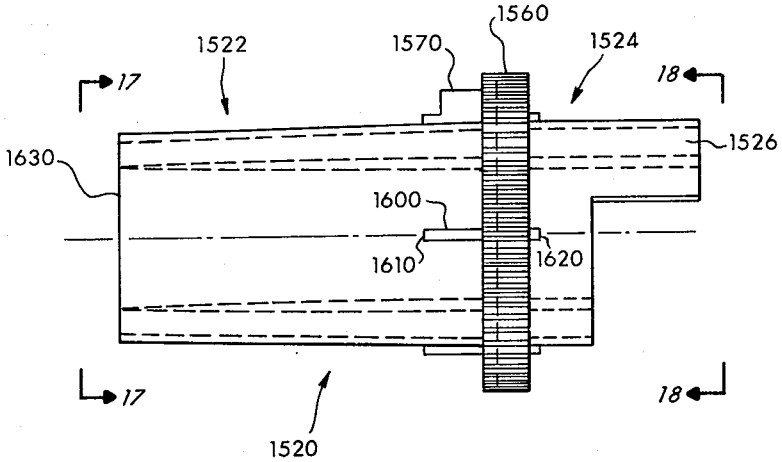
FIG. 16 is a side planar view of the gear mast of the present invention.
Figure 17:
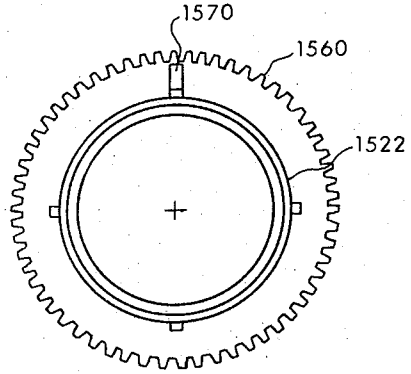
FIG. 17 is a first end view of the gear mast of FIG. 16.

The details of the gear mast 1520 are shown by reference to FIGS. 16 through 18. A series of support bridges 1600 are provided at 90° intervals around the circumference of cylinder 1522 at predetermined distances above and below the gear 1560. The upper edge 1610 of these support ridges are designed and located so that when the assembly shown in FIG. 15 is installed, edge 1610 abuts support plate 1510 and the lower edge 1620 abuts the rim 1200 surrounding the formed hole 1000 in the bottom of housing 402.

Hence, the gear mast 1520 is held vertically between the upper and lower housing portions. The upper portion 1522 of the gear is slightly tapered, about one degree, in decreasing diameter towards end 1630. When the mast 20 is inserted into the gear mast as shown in FIG. 4, it will firmly engage along the interior of the gear mast 1520.

In the preferred embodiment, the gear mast receives masts having diameters varying from $\frac{3}{4}''$ to $1\frac{1}{4}''$ although $1\frac{1}{4}''$ is more common. Longitudinal ribs 1528 are provided at 90° intervals on the interior of the gear mast to align the mast 20.

The connection portion 1526 is designed to be less than half the circumference of the gear mast so that the clamp 470 can bias the mast 20 against the interior of portion 1526. Again, masts of differing diameters can be utilized since the mast is held against the protrusion.

Figure 19:
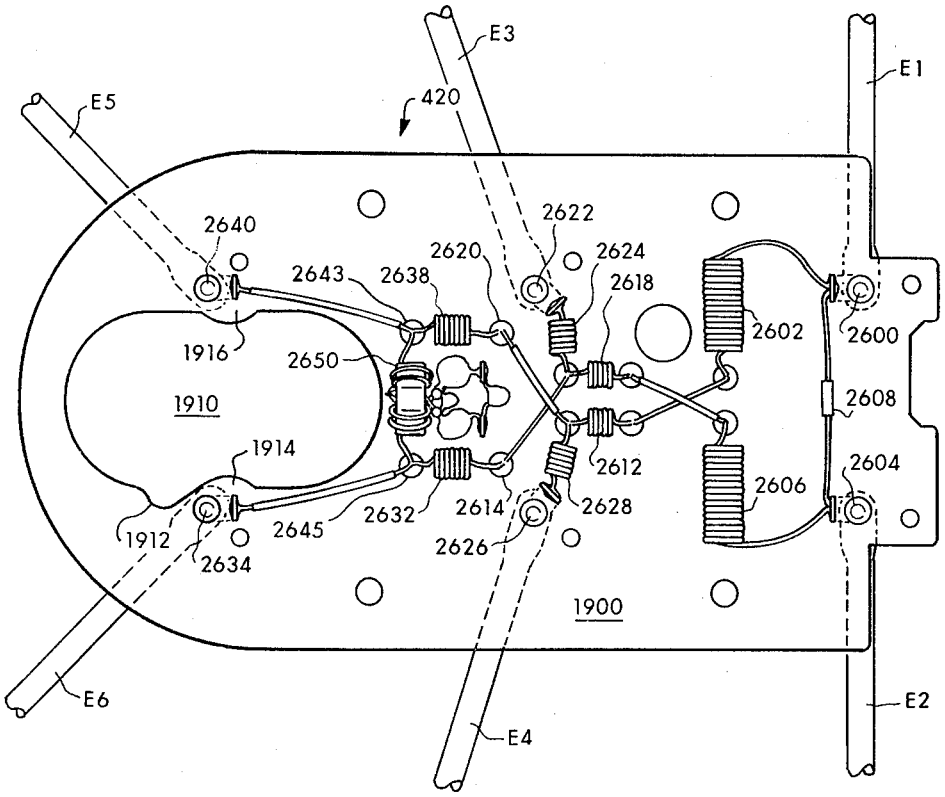
FIG. 19 is a bottom planar view of the support circuit for the antenna element halves of the present invention.

The circuit board 420 is shown in FIG. 19 with a number of components of the present invention mounted thereon. The board itself corresponds in dimension so that it snugly fits against the rim 950 of the lower housing, as shown in FIG. 12, and so that the upper surface 1900 is level with the upper surface of the rim 950. The board 420 has a large formed hole generally designated 1910 through which the rotor motor 440, the gear mast 1520, and the balun 2650 pass through as best shown by reference to FIG. 4. The formed depression 1912 allows for leads to come up into the rotor motor from the lower housing 402. The protrusions 1914 and 1916 provide added support to the connections width of the board to the element. The nature and arrangement of the various components shown on this circuit board will be subsequently discussed.

FIG. 20 sets forth the details of the connection of element 70 and board 1900 by means of a fastener 2000 engaging a flattened area 2010 of the element 70 and separated from the board 1900 by a lug spacer 2020. Hence, the element can be pivoted about connector 2000 when the housing is removed. However, the connector 2000 firmly engages the spacer 2020 so that an electrical connection can be made. As shown, the element 70 is supported by cup 972 of support post 970. In this position, the element 70 is slightly spaced above the upper surface 1900 of board 420. However, the element 70 abuts the lower surface of lip portion 510.

The interaction of the element 70 with the cup 972 and the lip 510 serves the following functions.

First the interaction provides primary support for the element thereby minimizing any force for supporting at the terminal or connector 2000. Sagging and loose electrical connections are substantially reduced with this approach.

Secondly the antenna elements 70 generate a large degree of force through a moment arm on the terminal 2000—especially during severe wind, ice, or the like. To substantially minimize or deload the effect of this moment arm force at the terminal 2000, the lips 510 and 920 cooperate with each other on the element 70 to provide relief in the form of a force absorber. As shown by arrow 2030, the lips 510 and 920 are capable of flexing with the element. Hence, substantially all of the moment force is dissipated by the lips 510 and 920 before reaching connector 2000. In order to obtain proper absorption of the force several design factors come into play. One factor is the width of the lips 510 and 920 designated by arrow 2040. The wider the lips are the greater the absorpotion (and support). However, a trade-off occurs with cost of materials. Another factor relates to the material used in making the lips. The material must be sufficiently flexible so as not to be brittle, yet not too flexible as to offer no resistance. In the preferred embodiment, the width of the lip is about one inch although the width can preferably be in the range of one-half inch to one and one-half inch. When compared to the length of the element, the width 2040 is preferably at least 1/54 the length of the element. The angle of flexing 2030 is preferably in the range of 1° to 10°.

The Antenna Elements

Figure 21:
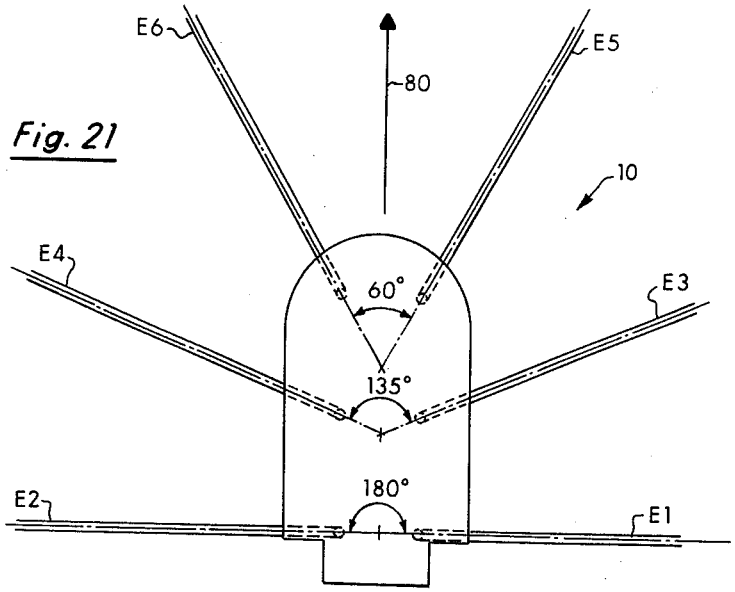
FIG. 21 is an illustration setting forth the orientation of the antenna elements of the present invention.

The compact antenna of the present invention has three elements 70. The first element, as shown in FIG. 21, is made from half sections E1 and E2. The second element is comprised of half sections E3 and E4 and are oriented in a V-configuration separated by a preferable apex angle of 135 degrees. The third element is formed from half sections E5 and E6, also formed in a V-shaped configuration, and separated by a preferable apex angle of 60 degrees. As previously mentioned, all half sections E1 through E6 are of a predetermined length and, in the preferred embodiment, this length is 27 inches.

Figure 22:
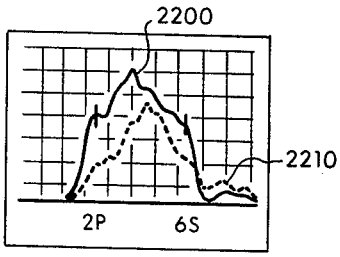
FIG. 22 is a graphical response of the antenna of the present invention in the low VHF band compared to Winegard Model CH7074.
Figure 23:
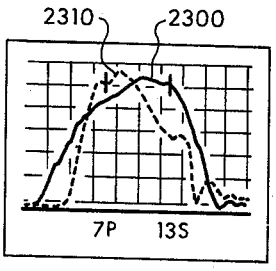
FIG. 23 is a graphical response of the antenna system of the present invention in the high VHF band compared to Winegard Model CH7074.
Figure 24:
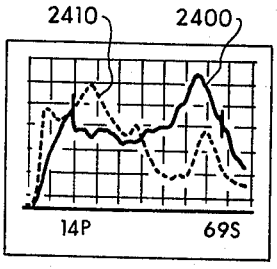
FIG. 24 is a graphical representation of the response of the antenna system of the present invention in UHF band compared to Winegard Model CH7074.
Figure 28:
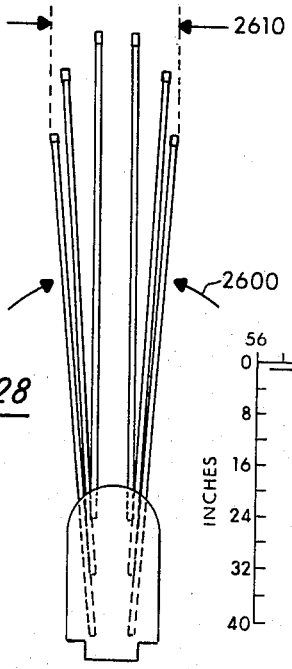
FIG. 28 is an illustration setting forth the collapsing of the antenna elements of the present invention for shipping.

The frequency response characteristics for the VHF-UHF bands are set forth in FIGS. 22 through 24. In generating the test results for the compact television antenna 10 of the present invention, a standard of comparison was required. Hence, the same tests were conducted on the commercially available CHROMSTAR Model CH7074 which is a small VHF-UHF television antenna available from Winegard.

The response of the antenna 10 of the present invention in the low VHF band, the high VHF band, and the UHF band will be disussed in the following. The three elements E1-E2, E3-E4, and E5-E6 respond differently in each band.

1. Low Band VHF Response

In FIG. 22, the low band VHF response of Model CH7074 is shown in curve 2200 whereas curve 2210 sets forth the frequency response for the compact antenna 10 of the present invention. Both antennas were tested under zero antennuation and the tests were conducted on the inside test range. The preamplifier in the present invention was not used in the tests.

The antenna gain comparison between the CH7074 and the antenna of the present invention is set forth below:

| CHANNEL | REFERENCE | PRESENT INVENTION |
|---|---|---|
| | LO-BAND | |
| 2 PC | 0.0 | −7.2 db |
| 4 PC | 0.0 | −7.0 db |
| 6 PC | 0.0 | −2.6 db |
| | HI-BAND | |
| 7 PC | 0.0 | +1.8 db |
| 10 PC | 0.0 | −1.4 db |
| 13 PC | 0.0 | −3.0 db |
| | UHF | |
| 14 PC | 0.0 | +0.6 db |
| 41 PC | 0.0 | +1.5 db |
| 69 SC | 0.0 | −4.0 db |

In operation on the low VHF band, the first element (halves E1 and E2) is a driven element which resonates in the lower portion of the low VHF band. Antenna element (halves E3 and E4) resonates primarily in the upper portion of the low VHF band. Hence, a composite response curve is shown in FIG. 22, as curve 2210, with a center substantially around channel 4. In the low band VHF, the third element (halves E5 and E6) is substantially inactive.

2. High Band VHF Response

FIG. 23 sets forth the high band VHF response for Model CH7074, as curve 2300, and for the compact antenna 10 of the present invention, as curve 2310. In this configuration. curve 2310 is also the composite of two separate resonances. In the high band of VHF, the second element (halves E3 and E4) resonates in the lower portion of the high VHF band. The third element comprising (halves E5 and E6) resonates in the higher portion of the high VHF band about channel 13. Hence, the composite curve 2310 peaks substantially around channel 9. The first element (halves E1 and E2) serves as a reflector in the high VHF band to increase the gain at the low end of the high VHF band and to give directivity to the antenna in this band.

3. UHF Band Response

In FIG. 24, the frequency response for the UHF band is set forth. Curve 2400 respresents the response for Model CH7074 whereas curve 2410 is the response curve for the compact antenna 10 of the present invention. In this band, only the element, (halves E5 and E6) is driven. The second element (halves E3 and E4) serves as a reflector. This reflection from the second element increases the low end gain of the third element and gives directivity to the antenna in this band. The first element (halves E1 and E2) is substantially inactive in the UHF band.

Polar Diagrams

Figure 25:
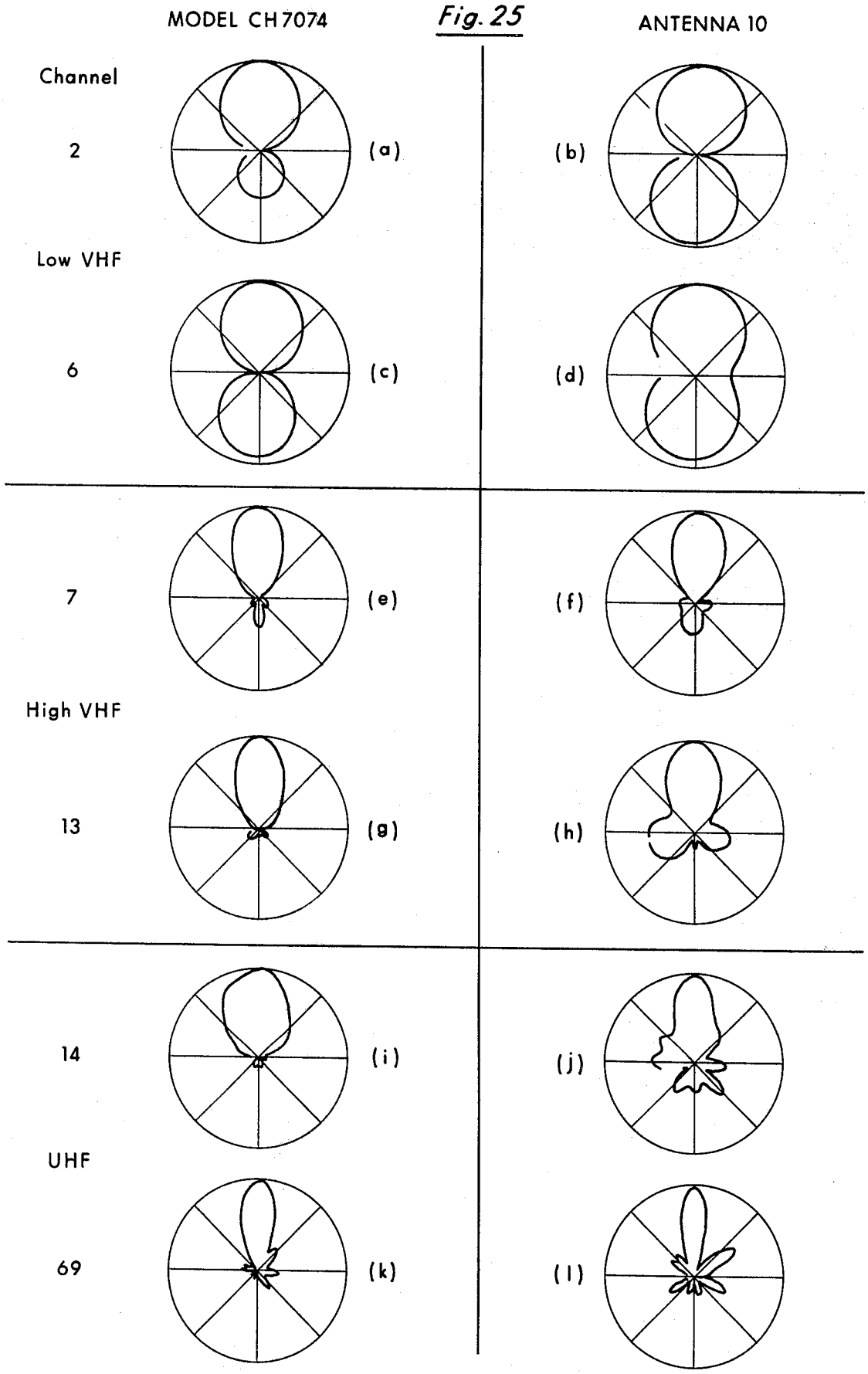
FIG. 25 sets forth the polar diagrams for the antenna system of the present invention in comparison to Winegard Model CH7074.

The polar diagrams are set forth in FIG. 25 for the compact antenna 10 of the present invention in comparison to the Model CH7074. The comparisons of the front-to-back ratios are set forth in the following table.

| Channel | Front-To-Back Ratio | |
|---|---|---|
| | Model CH7074 | Antenna 10 |
| 2 | 6 db | 0.4 db |
| 4 | 6.3 db | 0.8 db |
| 6 | 0.8 db | 0.9 db |
| 7 | 10.5 db | 10.2 db |
| 10 | 20 db | 20 db |
| 13 | 20 db | 17.5 db |
| 14 | 19 db | 10.5 db |
| 41 | 20 db | 7.5 db |
| 69 | 20 db | 14 db |

The 0.707 beam width comparisons are as follows:

| Channel | 707 Beam Width | |
|---|---|---|
| | Model CH7074 | Antenna 10 |
| 2 | 79° | 88° |
| 4 | 68° | 90° |
| 6 | 80° | 90° |
| 7 | 45° | 49° |
| 10 | 56° | 52° |
| 13 | 43° | 49° |
| 14 | 61° | 35° |
| 41 | 68° | 28° |
| 69 | 30° | 20° |

Circuit Description

Figure 26:
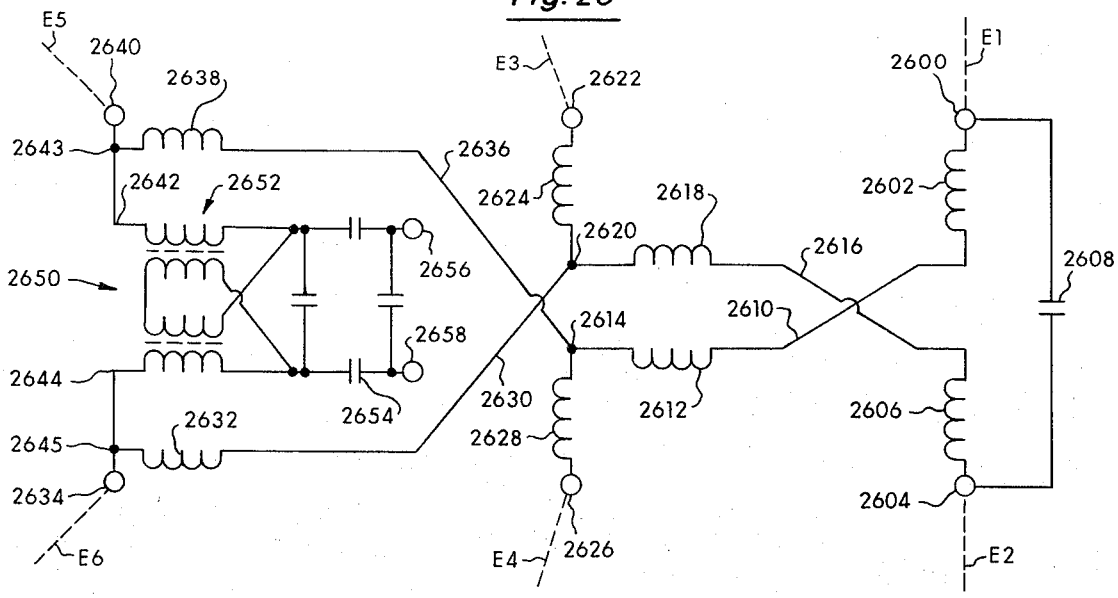
FIG. 26 is a schematic diagram of the circuits shown in FIG. 19.

FIG. 19 shows the circuit board 420 with the electronic schematic for this board shown in FIG. 26. This circuit includes a number of components interconnected as follows. Terminal 2600 is connected to one end of element half E1 and is further connected to a wire coil 2602 wound on a one-quarter of an inch core comprising 19 turns of 18 gauge wire (approximately ¾" long). Coil 2602 is oriented as shown in FIG. 19, for sake of reference, on the board in a vertical orientation substantially parallel to element half E1. Correspondingly coupled to terminal 2604 is one end of element half E2 and a coil 2606 which is also 19 turns of 18 gauge wire wound on a one-quarter inch core. Coils 2602 and 2606 are substantially identical in construction and in performance characteristics. Interconnected between terminals 2600 and 2604 is a capacitor identified as 2608 which is preferably one pico farad. This capacitor provides matching on the high VHF band.

Coil 2602 is interconnected diagonally by wire 2610 to coil 2612 which is located in a horizontal plane substantially perpendicular to coil 2602. Coil 2612 comprises 8 turns of 18 gauge wire wound on a 3/16 inch diameter (about ¼" in length). Coil 2612 terminates at node 2614. Likewise, coil 2606 is delivered diagonally by means of wire 2616 to coil 2618 which is substantially identical to coil 2612. Coil 2618 is also located in a horizontal plane parallel to coil 2612 and perpendicular to coil 2606. Coil 2618 terminates in node 2620.

Element half E3 is connected to terminal 2622 as is one end of coil 2624 which has eleven turns of 18 gauge wire wound on a 3/16 inch diameter (5/16" long). Coil 2624 is arranged substantially vertically on the board being substantially aligned with element half E3 and is interconnected with coil 2618 at node 2620. Likewise, element half E4 is connected with terminal 2626 which in turn is connected to coil 2628. Coil 2628 substantially identical to coil 2624 and is connected at its opposing end to node 2614.

A wire 2630 interconnects node 2620 with coil 2632. The other end of coil 2632 is directly connected to terminal 2634 which in turn is connected to element half E6. Likewise, diagonal wire 2636 connects node 2614 to coil 2638. Coil 2638 has its other end directly connected to terminal 2640. Coils 2632 and 2638 are substantially identical to each other, each comprising seven turns of 18 gauge wire wound on a 3/16 inch diameter (⅛" long). Terminal 2640 is connected over wire 2642 to one input of a balun generally identified as 2650. The other input of balun 2650 is connected over wire 2644 to terminal 2634 which is connected to element half E6. The balun 2650 is a conventional ferrite core 2652 4:1 balun. The 4:1 balun 2650 creates an impedance match from the 300 ohm antenna at terminals 2640 and 2634 to the 75 ohms down lead at terminals 2656 and 2658. The operation of the circuit as shown in FIG. 26 in the low VHF band, the high VHF band, and the UHF band will now be discussed. Before discussing what is believed to be the operation of the antenna of the present invention, it is to be noted that antenna theory in general often belies precise formulation and is rather primarily an art based upon practical experience and experimentation. This is true for the antenna system of the present invention.

As pointed out in U.S. Pat. No. 3,392,399, the relative close spacing presents "a more favorable radiation capture capability for the antenna . . . while maintaining relatively broad band response and favorable gain." (Col. 6) In this patent the spacing reached 0.1 wavelength with reference to the high end of the high VHF band (i.e., 5.43 inches). In the antenna 10 of the present invention the physical spacing between the VHF elements is about 1.5 inches or almost 400% shorter than the 399 approach. During experimentation at these short spacings for the present invention, it was discovered that if the antenna elements were oriented parallel to each other very low performance was obtained. However, by positioning some of the elements in V-configurations a significant response was obtained. Furthermore, if the elements were spaced closer than 1.5 inches at the driven end then the response dropped off. Other acceptance V-configurations are possible on a variety of shapes, for example, an acceptance combination included: forward V for element E5–E6, straight for element E3–E4, and reverse V for element E1–E2. However, the configuration set forth in the drawing is preferred.

Despite this extreme shortness in spacing, under the teachings of the present invention relatively broad band response and favorable gain were achieved similar to that obtained from a conventional large multi-element antenna such as the Model 7074.

All coils in the circuit discussed above are tightly wound.

1. Low Band UHF Circuit Operation

In the low VHF band, and as previously mentioned, the third element E5 and E6 is substantially inactive, thus signals in this band are primarily received from the first and second elements (E1–E2 and E3–E4, respectively). In the low VHF band, the circuit operates with the first and second elements as follows.

Coils 2602 and 2606 being tightly wound contain substantial inductance and electrically lengthens the physical length of halves E1 and E2 for the first element. In other words, the coils 2602 and 2606 electrically lengthens the 54 inch element E1–E2 so that the first element substantially half-wave resonates in the lower portion of the low VHF band.

When a coil having inductance is coupled to a driven element to lower resonance a certain tradeoff between gain and size occurs because of capture area loss. Clearly, if no coil were utilized, an antenna of about 98.4 inches would have to be utilized for ½ wave resonance (at 54 MHZ) in the lower half of the low VHF band. When a coil is used to lower the resonance of the driven element, the gain of the element is reduced. Hence, the larger the coil that is added and the less the physical length of the driven element, the lower the actual capture area and the lower the gain of the element. This is the tradeoff occurring in the present invention between element E1–E2 and coils 2602 and 2606.

It is believed that the coils 2602 and 2606, being oriented substantially parallel to the E1 and E2 halves, also receives the low VHF signal.

The same tradeoff in the low VHF band, discussed above, appears for the relationship between the physical length of the second element E3–E4 and coils 2624 and 2628. Since one object of the present invention is to provide a compact antenna wherein the elements are of the same physical length, by properly designing coils 2624 and 2628, the physical length of the second element halves E3–E4 can be maintained at 27 inches. Hence, the design of coils 2624 and 2628 in cooperation with the second element is such as to provide substantially one-half wave resonance in the upper portion of the low VHF band.

In summary, the design of the first and second elements in conjunction with the coils 2602–2606 and 2624–2628 are such that a tradeoff has occurred to optimize the response for the low VHF band as shown in FIG. 22. The lengthening coils of the present invention can be adopted for use in antennas designed for frequencies other than UHF and VHF.

Another consideration in the low VHF band operation of the circuit is the interaction between the signals received from the first element E1–E2 and the second element E3–E4. The low band VHF signals from both elements are combined at nodes 2614 and 2620. The lower portion low band VHF signals received by the first element comprising halves E1 and E2 are crossed over via leads 2610 and 2616 to nodes 2614 and 2620 in order to be in proper phase with the higher portion low band VHF signals appearing from the second element E3–E4. Hence, in a conventional arrangement, if the physical distance between the first element E1–E2 were a quarter wave length spaced apart from the second element E3–E4, the combined signals would be in perfect phase relationship at nodes 2614 and 2620.

Under the teachings of U.S. Pat. No. 3,392,399 the spacing can approach 1/10 of the wavelength of the highest VHF frequency or 5.75 inches by using sinuosite feeder lines. However, these feeder lines are free of any inductance since the curved portions are in the same plane and any inductance is necessarily cancelled out. Being formed as a sinuosite, the feeder line is actually a transmission line of the required quarter-wavelength.

Under the teachings of the present invention, however, a coil containing inductance is used in place of the sinuosite feeder line which delays the signal electrically and, hence, operates in principle differently than the use of sinuosite feeder lines. In this particular embodiment, the spacing between the first and second elements is substantially less than the one-tenth wavelength achieved through use of sinuosite feeder lines.

In the preferred embodiment, the electrical delay is provided by the inductance of coils 2612 and 2618. Hence, the electrical delay provided by these coils provides substantially the same phase matching for the signals from the first and second elements as if the first and second elements were physically spaced a quarter of a wavelength apart. This particular approach enables a significant degree of compactness to occur between the first and second elements in the VHF band.

While the preferred embodiment uses a cross-over connection for the delay coils, the principle can be adapted for use in non-crossover, straight fed situations. Furthermore, the use of the delay coils of the present invention can be adapted for antenna designs using frequencies other than UHF and VHF.

It is to be observed, that due to the substantially orthogonal relationship between the physical positioning of coils 2612 and 2618 and coils 2602–2606 and 2624–2628, the coils 2612 and 2618 do not add to the capture of the first two elements. At the same time, the coils 2602–2606 and 2624–2628 do not add to the delay but electrically lengthens the first two elements. The relationship of function and performance to the orthogonal oriented coils is of importance to the operation and contributes to the overall high degree of compactness enjoyed by the antenna 10 of the present invention. If coils 2618 and 2612 were removed, the physical spacing between the first element E1–E2 and the second element E3–E4 would have to be substantially increased to maintain gain. Removing coils 2618 and 2612 from the configuration and replacing it with a solid wire would result in a combined low VHF signal at nodes 2614 and 2620 of extremely low gain. If coils 2602 and 2606 were removed from the circuit and replaced by straight wire, the first element E1 would resonate in the FM band and would not provide an output in the low VHF band of any significance.

By evaluating the overall tradeoffs concerning the capture area and for coils 2602–2606 and coils 2624–2628 and by providing delay coils 2612 and 2618 of proper design between the two elements, the resulting signals from the first two elements (which are electrically lengthened and are electrically placed in phase by proper delay inductance) provide an optimum low VHF signal at nodes 2614 and 2620 as shown in FIG. 22.

In the present embodiment, it should also be pointed out that the response of the antenna 10 could be increased by physically lengthening the various elements and/or by physically spacing the elements further apart. However, the tradeoff of response for cost and installation capabilities must be compared. It is significantly less costly to produce an antenna wherein all of the elements are of the same physical length both from a manufacturing and inventory viewpoint than it is to design an antenna wherein the elements are of differing lengths and spaced at different distances. Furthermore, certain asthetic considerations pertaining to consumer or customer use must be evaluated. It was a goal of the present embodiment to achieve a highly compact antenna usable, for example, in the room of a building having a satisfactory response (not necessarily maximum).

Hence, when manufacturing considerations are evaluated, when cost considerations are evaluated, when consumer appearance and appeal are evaluated the antenna 10 of the present invention was arrived at. Even so, through use of electrical lengthening coils and through use of electrical delay coils, the antenna 10 of the present invention has a suitable response characteristic comparable to a large multi-element antenna such as the Model CH7074.

The combined low VHF band signal appearing at nodes 2614 and 2620 are then delivered through coils 2632 and 2638, in phase, to the input of the balun 2650.

2. High Band VHF Circuit Operation

In the high VHF band, the circuit shown in FIGS. 19 and 26 operates as follows. The first element E1–E2 acts as a full wave reflector for the second and third two elements and is not driven in the high VHF band. However, the second element E3–E4, as previously mentioned, substantially full-wave resonates in the lower portion of the high VHF band. For example, element E3–E4 is electrically lengthened by coils 2624 and 2628 in the same fashion as priorly discussed. To the contrary, the third element E5–E6 is not electrically lengthened but is designed to be driven at full wave resonance in the higher portion of the high VHF band as is conventionally done. Hence, the third element exhibits higher gain due to its natural resonance and the lack of any electrical lengthening. The higher portion of the high VHF band signals received by the third element E5–E6 is combined with the lower portion of the high VHF band signals from the second element E3–E4 on leads 2642 and 2644. Hence, proper phase relationship is maintained between second and third elements by coils 2638 and 2632 in the same fashion as priorly discussed. The spacing between terminal 2622 and node 2643 is $1\frac{3}{8}''$.

3. UHF Band Circuit Operation

Finally, the response of the circuit shown in FIGS. 19 and 26 for the UHF band will be discussed. The coils 2638 and 2632 isolate the third element E5–E6. Therefore, the third element E5–E6 due to its significant V-shape resonates (i.e., 2–3 wavelengths) across the UHF band and with the added gain from the reflector action of the second element E3–E4, greater gain is delivered on the low end. Significantly, the physical length of the element and the angular relationship is such to provide a good response in the UHF band as shown in FIG. 24.

Figure 27:
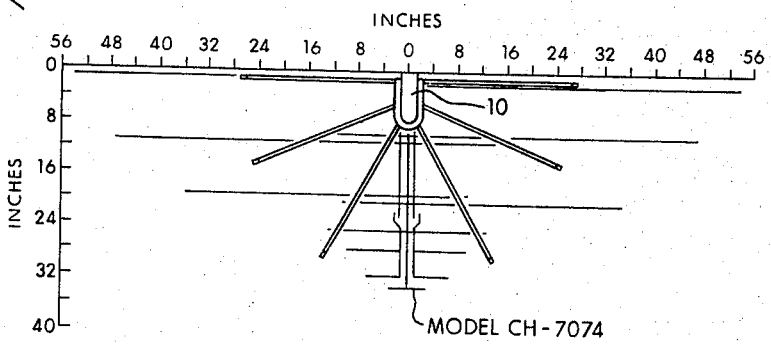
FIG. 27 sets forth the physical size of the antenna of the present invention in relationship to the Winegard Model CH7074.

In FIG. 27, the antenna 10 of the present invention is shown compared to the Model CH7074 as to physical size. It is to be noted that Model CH7074 is over twice the size of the antenna of the present invention and is comprised of seven different sizes in antenna element lengths. This is compared to the compact antenna 10 of the present invention where one size is used for all elements.

The distinct advantage of having the smaller physical spacing between the elements can be appreciated by reference to FIG. 27. Hence, the overall physical spacing from the first element E1–E2 to the third element E5–E6 in the antenna 10 of the present invention is significantly reduced in comparison to the overall length on the boom of Model CH7074 (i.e., 8" v. 32" a 75% reduction). In Model CH7074 approximately 420 inches of antenna material is used whereas in the antenna 10 of the present invention only approximately 162 inches is used. Hence, Model CH7074 has approximately 250% more material than the antenna of the present invention. Furthermore, Model CH7074 requires seven different lengths of elements whereas the antenna of the present invention requires only one length—an 86% reduction. The antenna 10 of the present invention is also lighter in weight than the Model CH7074. Furthermore, the turning radius of the antenna of the present invention is approximately 50% less than the Model CH7074 (i.e., 30" v. 56"). Hence, the antenna of the present invention can be more easily mounted in attic environments and can most certainly be mounted in residential environments such as the living room.

Despite these significant "physical" differences between the antenna 10 of the present invention and Model CH7074, the performance characteristics of the two are comparable.

While one basic embodiment of the present invention has been described in detail herein and was arrived at by weighing all of the above factors, various changes and modifications can be made without departing from the scope of the invention. For example, the delay coils of the present invention, the lengthening coils of the present invention, or the combination of both delay and lengthening coils can be adapted for other than UHF and VHF antennas such as FM antennas. Also, while three elements have been used in the preferred embodiment, it is to be understood that more than three elements, such as four elements, could be utilized in conjunction with the delay and lengthening coils of the present invention. And, additional reflector elements could be provided to increase gain.

We claim:

1. A low and high band VHF and UHF antenna comprising:

an elongated support having a front directed at a source of low and high band VHF and UHF signals, a rear and substantially longitudinal sides, a first element having two half sections mounted to said support located on said longitudinal sides and near said rear of said support, each of said first element half sections having one end affixed to said support and being oriented directly opposing each other, said first element being capable of substantial reflection of said high VHF signals, a first pair of lengthening coils mounted on said support in substantial alignment with said first element, each of said first pair of lengthening coils having one end connected to the aforesaid affixed end of said first element half section, said first element half sections in cooperation with said first pair of lengthening coils being capable of substantial resonance in the lower portion of the low VHF band for receiving first low VHF signals, a second element having two half sections mounted to said support located on said longitudinal sides and near the center of said support, each of said second element half section having one end affixed to said support and being oriented to form an open V-shaped configuration, the open end of the aforesaid V-shaped configuration being directed toward said front of said support, said second element being capable of substantial reflection of said UHF signals, a second pair of lengthening coils mounted on said support in substantial alignment with said second element, each of said second pair of lengthening coils having an end connected to the aforesaid affixed one end of said second element half sections, said second element half sections in cooperation with said second pair of lengthening coils being capable of substantial resonance in the high portion of the low VHF band for receiving second low VHF signals, said second element half sections in cooperation with said second pair of lengthening coils being further capable of substantial resonance in the low portion of the high VHF band for receiving first high VHF signals, a first pair of delay coils having inductance mounted on said support, each of said first delay coils connected on one end to the ends of said first pair of lengthening coils not connected to said first element half sections, each of said first delay coils being connected on the other end to the ends of said second pair of lengthening coils not connected to said second element half sections, said first pair of delay coils being oriented substantially parallel to the longitudinal axis of said support, said first pair of delay coils being capable of delaying said first low VHF signal sufficiently to produce a combined low VHF signal having a phase relationship between said first low VHF signal and said second low VHF signal that is substantially additive, a third element having two half sections mounted to said support located on said longitudinal sides near said front of said support, each of said third element half sections having one end affixed to said support and being oreinted to form an open V-shaped configuration, the open end of the aforesaid V-shaped configuration being directed toward said front of said support, said third pair of elements being capable of substantial full-wave resonance in the high portion of the high VHF band for receiving second high VHF signals, said third pair of elements being capable of substantial multiple wavelength resonance in the UHF band for receiving UHF signals, a second pair of delay coils having inductance mounted on said support, each of said second delay coils connected on one end to the ends of said second set of lengthening coils connected to said first pair of delay coils, each of said second delay coils being connected on the other end to said affixed ends of said third element half sections, said second pair of delay coils being oriented substantially parallel to said longitudinal axis, said second pair of delay coils being capable of delaying said first high VHF signal sufficiently to produce a combined high VHF signal having a phase relationship between said first high VHF signal and said second high VHF signal that is substantially additive, and means receptive of said combined low VHF signal, said combined high VHF signal and said UHF signal for delivering the aforesaid signals from said antenna.

2. The antenna of claim 1 wherein the physical length of said first, second, and third elements are the same length.

3. The antenna of claim 1 wherein the physical spacing between said first and said second elements and the physical spacing between said second and third elements are each less than one-tenth the wavelength of the highest frequency in the high VHF band.

4. A low and high VHF and UHF television antenna comprising:

an elongated support having a front directed at a source of low and high band VHF and UHF signals, a rear and substantially longitudinal sides, a first element having two half sections mounted near said rear of said support, the aforesaid element being oriented substantially perpendicular to said longitudinal sides in a horizontal plane, said first element being capable of substantial reflection of said high VHF signals, means cooperative with said first element for receiving a first low VHF signal by enabling said first element to substantially resonate in the lower portion of the VHF band, a second element having two half sections mounted in the center of said support, the aforesaid element laying in said plane with each of the aforesaid half sections being oriented to form an open V-shaped configuration, the open-end of the aforesaid V-shaped configuration being directed toward said signal source, said second element being capable of substantial reflection of said UHF signals, means cooperative with said second element for receiving a second low VHF signal by enabling said second element to substantially resonate in the high portion of the low VHF band and for receiving a first high VHF signal by substantially resonating in the low portion of the high VHF band, means connected to said first and second elements for producing a combined low VHF signal by combining said first and second low VHF signals together in a substantial phase relationship, a third element having two half sections mounted near the front of said support, the aforesaid element laying in said plane with each of the aforesaid halves being oriented to form an open V-shaped configuration, the open-end of the aforesaid V-shaped configuration being directed toward said signal source, said third element receiving a second high VHF signal by substantially resonating in the high portion of the high VHF band and receiving a UHF signal by substantially resonating in the UHF band, means connected to said second and third elements for producing a combined high VHF signal by combining said first and second high VHF signals together in a substantial phase relationship, and means receptive of said combined low VHF signal, said combined high VHF signal and said UHF signal for delivering the aforesaid signals from said antenna.

5. The antenna of claim 4, wherein the physical length of said first, second, and third elements are the same length.

6. The antenna of claim 5 wherein said physical length is 27 inches.

7. The antenna of claim 4 wherein the spacing between said first and said second elements and between said second and third elements are each less than one-tenth the wavelength of the highest frequency in the high VHF band.

8. A low and high band VHF and UHF antenna comprising:

an elongated support having a front directed at a source of low and high band VHF and UHF signals, a rear and substantially longitudinal sides, a first element directed towards said source mounted near said rear of said support, said first element being capable of substantial reflection of said high band VHF signals, means cooperative with said first element for receiving a first low VHF signal by enabling said first element to substantially resonate in the lower portion of the VHF band, a second element directed towards said source mounted in the center of said support and spaced less than one-tenth of the wavelength of the highest frequency in the high VHF band from said first element, said second element being capable of substantial reflection of said UHF band signals, means cooperative with said second element for receiving a second low VHF signal by enabling said second element to substantially resonate in the high portion of the low VHF band and for receiving a first high VHF signal from substantial resonance in the low portion of the high VHF band, means receptive of said first and second low VHF signals for combining said signals together in a substantial phase relationship to produce a combined low VHF signal, a third element directed towards said source mounted near the front of said support and spaced less than one-tenth of the wavelength of the highest frequency in the high VHF band from said second element, said third element being capable of receiving a second high VHF signal by substantially resonating in the high portion of the high VHF band and of receiving a UHF signal from multiple wave resonance in the UHF band, means receptive of said first and second high VHF signals for combining said signals together in a substantial phase relationship to produce a combined high VHF signal, and means receptive of said combined low VHF signal, said combined high VHF signal and said UHF signal for delivering the aforesaid signals from said antenna.

9. The antenna of claim 8 wherein said first, second, and third elements are each the same length.

10. An antenna directed at a source of low and high band VHF and UHF signals comprising:

a first element, said first element being capable of substantial reflection of said high band VHF signals, means cooperative with said first element for receiving a first low VHF signal by enabling said first element to substantially resonate in the lower portion of the VHF band, a second element oriented closer to said signal source than said first element and in the same plane as said first element, said second element being capable of substantial reflection of said UHF band signals, means cooperative with said second element for receiving a second low VHF signal by enabling said second element to substantially resonate in the high portion of the low VHF band and for receiving a first high VHF signal by substantial resonance in the low portion of the high VHF band, means receptive of said first and second low VHF signals for combining said signals together in a substantial phase relationship to produce a combined low VHF signal, a third element oriented closer to said signal source than said second element and in the same plane as said second element, said third element being capable of receiving a second high VHF signal by substantially resonating in the high portion of the high VHF band and of receiving a UHF signal through multiple wave resonance in the UHF band, means receptive of said first and second high VHF signals for combining said signals together in a substantial phase relationship and for producing a combined high VHF signal, and means receptive of said low combined VHF signal, said combined high VHF signal, and said UHF signal for delivering the aforesaid signals from said antenna.

11. The antenna of claim 10 wherein said first, second, and third elements are of the same physical length.

12. The antenna of claim 10 wherein the physical spacing between said first and said second elements and the physical spacing between said second and third elements are each less than one-tenth the wavelength of the highest frequency in the high VHF band.

13. A low and high band VHF and UHF antenna comprising:

a longitudinal support, a first element mounted near the rear of said support, said first element being oriented to lay in a plane substantially perpendicular to the longitudinal axis of said support, a second element mounted in the center of said support, said second element being oriented to lay in said plane and to form an open V-shaped configuration having an apex angle of substantially 135 degrees, the open end of the aforesaid V-shaped configuration being directed toward the front of said support, and a third element mounted near the front of said support, said third element being oriented to lay in said plane and to form an open V-shaped configuration having an apex angle of substantially 60 degrees, the open end of the aforesaid V-shaped configuration being directed toward the front of said support, said first, second and third elements being of equal length.

14. The antenna of claim 13 wherein the spacings between said first and said second elements and between said second and said third elements are less than one-tenth the wavelength of the highest frequency in the high VHF band.

15. An antenna for combining electromagnetic signals at a predetermined frequency received by a first antenna element having first and second end-driven half sections and electromagnetic signals at said predetermined frequency from a second antenna element having first and second end-driven half sections, said first and second elements being spaced apart a predetermined distance in the same plane on the same longitudinal support, said antenna comprising:

a first inductor coil containing a predetermined amount of inductance having one end connected to the output of said first half section of said first element and having its second end cross-connected to one of the outputs of said half sections of said second element, said first inductor being oriented in said plane substantially perpendicular to said first element, and a second inductor coil containing said predetermined amount of inductance having one end connected to the output of said second half section of said first element and having its second end cross-connected to the remaining output of said half sections of said second element, said second inductor being oriented in said plane substantially parallel to said first inductor, said first and second inductors capable of delaying the received electromagnetic signals from the first element sufficiently to be in phase with the received electromagnetic signals from the second element, said predetermined amount of inductance in said first and second coils being sufficient to reduce said predetermined distance to less than substantially one-tenth the wavelength of said predetermined frequency, said first and second elements being of equal physical length, and said second element having its half sections oriented to form an open V-shaped configuration opening forward and in front of said first element.

16. The antenna of claim 13 further comprising each of said first, second and third elements having a first end of said element affixed to a terminal mounted in said support and having the second end of said element freely extending into the atmosphere, said support comprising means engaging the circumference of each of said elements at a predetermined distance from said affixed end for supporting said element, said supporting means being capable of flexing through a predetermined apex angle when each of said elements are subjected to moment forces by said atmosphere, said apex angle being oriented substantially perpendicular to the plane in which said terminal and said element lay, said supporting and deloading means being capable of minimizing any forces at said terminal.

17. The antenna of claim 16 wherein said means comprises:

a housing containing said terminal, a first flexible lip extension from said housing oriented in a plane above and parallel to the plane in which said elements reside in, said upper lip extension having a downwardly extending means for engaging the upper circumference portion of each of said elements at said predetermined distance, and a second flexible lip extension from said housing oriented in a plane below and parallel to the plane in which said elements reside in, said lower lip extension having an upwardly extending means for engaging the lower circumference portion of each of said elements.

18. The apparatus of claim 17 wherein said upper lip extension abuts the upper surface of each said elements substantially along the entire length of said predetermined distance.

19. The antenna of claim 13 further comprising:

a support mast connected to said support for use in the room of a building, said room having a floor and a ceiling, said support mast being capable of engaging said floor and ceiling of said room in an orientation substantially vertical to said floor, a hollow housing having a front, a back, top, bottom and longitudinal sides, said housing having formed holes in said top and bottom of said housing, said formed holes being aligned and being capable of receiving said support mast therethrough, and means in said housing for holding said support.

20. The antenna system of claim 19 further comprising means in said housing for selectively rotating said housing about said support mast.

21. The antenna of claim 13 further comprising:

a support mast, a hollow weatherproof housing having a front, back, top, bottom and longitudinal sides containing said longitudinal support, said housing having a formed hole in said bottom for receiving one end of said mast, means for releasably connecting said hollow housing to said support mast, and means mounted through said housing for extending said signals from said first, second, and third elements.

22. The antenna of claim 21 wherein said connecting means is capable of receiving any one of a plurality of support masts having different diameters.

23. The antenna of claim 21 further comprising a preamplifier selectively mounted in the interior of said housing, said preamplifier being further interconnected with said first, second, and third elements for amplifying said signals, said amplified signals being delivered to said extending means.

24. The antenna of claim 21 further comprising:

means capable of being mounted on the interior of said housing and engaging said support mast for rotating said entire housing about said support mast, means external of said housing for generating rotate signals in response to a manual input, and means for extending said rotate signals from aforesaid generating means through said housing to said rotate means.

25. The antenna of claim 21 further having drain holes formed in said bottom of said housing.

26. The antenna of claim 21 further comprising:

a preamplifier selectively mounted in the interior of said housing, said preamplifier being further interconnected with said first, second, and third elements for amplifying said signals, said amplified signals being delivered to said extending means, means capable of being mounted on the interior of said housing and engaging said support mast for rotating said entire housing about said support mast, means external of said housing for generating rotate signals in response to a manual input, and means for extending said rotate signals from aforesaid generating means through said housing to said rotate means.

27. The antenna of claim 13 further comprising:

a support mast, a hollow weatherproof housing having a front, back, top, bottom and longitudinal sides, said housing having a formed hole in said bottom and containing said longitudinal support, a substantially cylindrically shaped gear mast having a bottom end oriented in the aforesaid hole, said gear mast extending from said housing bottom to said housing top on the interior of said housing, said gear mast having a top end engaging the interior of said housing top, said gear mast being capable of rotating in said housing, said gear mast being capable of releasably connecting to one end of said support mast, a circular gear disposed around and integral with said gear mast, a motor with a driveshaft mounted in said housing, means for operatively interconnecting said driveshaft of said motor to said gear mast, means for controlling the position of said housing in relation to said gear mast, said controlling means being capable of stopping the direction of said driveshaft when said housing has rotated substantially 360° about said gear mast, and means exterior of said housing for generating rotate signals to said motor in response to a manual input.

28. The antenna of claim 27 wherein said controlling means comprises a raised notch on the circumference of said gear mast and a switch mounted to interior of said housing responsive to the position of said notch.

29. A low and high band VHF antenna comprising:

a longitudinal support, a first element means mounted on said support, a second element means mounted on said support, said first and second element means cooperating to receive low band VHF signals, said first and second element means each comprising:

(a) opposing element half sections having their inboard ends mounted to said support, and (b) A lengthening coil connected to each inboard end and in substantial alignment with said connected half section, and a third element means mounted on said support, said second and third element means cooperating to receive high band VHF signals, the physical spacings between said first and said second element and between said second and said third elements on said support being less than one-tenth the wavelength of the highest frequency in the high VHF band said half sections of said first element means being connected to said support and oriented to lay in a plane substantially perpendicular to the longitudinal axis of said support, said half sections of said second element means being connected to said support and oriented to form an open V-shaped configuration having an apex angle of substantially 135 degrees, the open end of the aforesaid V-shaped configuration being directed toward the front of said support, and said half sections of said third element being connected to said support and oriented to form an open V-shaped configuration having an apex angle of substantially 60 degrees, the open end of the aforesaid V-shaped configuration being directed toward the front of said support.

30. The antenna of claim 29 wherein the physical length of said first, second, and third elements are the same length.

* * * * *